US007302743B2

(12) United States Patent
Fash

(10) Patent No.: US 7,302,743 B2
(45) Date of Patent: Dec. 4, 2007

(54) REUSABLE CASKET

(75) Inventor: Harry J. Fash, 3636 Limekiln Pike, Chalfont, PA (US) 18914

(73) Assignees: Laurie A. Fash, Chalfont, PA (US); Harry J. Fash, Chalfont, PA (US)

( * ) Notice: Subject to any disclaimer, the term of this patent is extended or adjusted under 35 U.S.C. 154(b) by 97 days.

(21) Appl. No.: 10/901,306

(22) Filed: Jul. 28, 2004

(65) Prior Publication Data

US 2005/0108863 A1 May 26, 2005

Related U.S. Application Data

(60) Provisional application No. 60/544,740, filed on Feb. 13, 2004, provisional application No. 60/490,681, filed on Jul. 28, 2003.

(51) Int. Cl.
*A61G 17/00* (2006.01)

(52) U.S. Cl. ..... 27/4; 27/35; 27/27; 16/424; 292/302

(58) Field of Classification Search ..... 27/2, 27/4, 12, 35, 19, 27, DIG. 1; 16/424, 439; 292/302

See application file for complete search history.

(56) References Cited

U.S. PATENT DOCUMENTS 560,253 A * 5/1896 Blackford et al. ..... 27/4
604,334 A * 5/1898 Myers ..... 27/4
614,051 A * 11/1898 Hammel ..... 27/4
658,261 A * 9/1900 Herbold ..... 27/4
706,398 A * 8/1902 Ernst ..... 27/4
780,468 A * 1/1905 Anderson et al. ..... 27/4
843,157 A * 2/1907 Lawson ..... 27/4
876,031 A * 1/1908 Watt et al. ..... 27/4
1,321,579 A * 11/1919 Watkins ..... 27/4
2,050,675 A * 8/1936 Tanner ..... 27/4
3,133,334 A * 5/1964 Johnsen ..... 27/27
4,177,543 A * 12/1979 Angermann ..... 27/35
4,788,757 A * 12/1988 Bethune et al. ..... 27/2
5,481,785 A * 1/1996 Minton et al. ..... 27/27
6,684,467 B1 * 2/2004 Walker ..... 27/35

* cited by examiner

*Primary Examiner*—William L. Miller
(74) *Attorney, Agent, or Firm*—Charles N. Quinn

(57) ABSTRACT

A reusable casket includes a rectangular solid-configured body preferably having a casket top hingedly connected to a casket rear for pivotal movement between a casket-open position and a casket-closed position, a casket front pivotally connected to a casket bottom between a casket-closed position and a casket-open position, a latch for retaining the casket front in the casket-closed position and a lock for securing the casket top to the casket front. The reusable casket also has a tray for supporting a disposable cremateable container for human remains and track assemblies connected to the casket bottom for rotatably supporting the tray during tray movement along the casket bottom.

22 Claims, 20 Drawing Sheets

REUSABLE CASKET

CROSS-REFERENCE TO RELATED APPLICATIONS

This patent application claims the benefit under 35 U.S.C. § 119(e) of U.S. provisional patent application 60/490,681, filed Jul. 28, 2003, and U.S. provisional patent application 60/544,740, filed Feb. 13, 2004, which are both hereby incorporated by reference in their entirety for all purposes.

BACKGROUND OF THE INVENTION

1. Field of the Invention

The invention disclosed herein relates generally to a reusable casket and a method for transferring remains from such a reusable casket.

2. Description of the Prior Art

The costs associated with funerals are high. The family of the deceased often pays from $10,000.00 to $30,000.00 or more. These costs include, for example, the costs of the casket, the clergy, a headstone, opening and maintenance of a cemetery grave, embalming the body and/or other costs, such as catering, transportation, etc.

The cost of the casket alone can range from $5,000.00 to $20,000.00 or more, depending on construction and level of ornamentation of the casket. Caskets are divided economically into at least two groups: less expensive wood caskets and more expensive metal caskets. Metal caskets are generally perceived to be of higher quality in terms of aesthetics, strength, and resistance to decomposition. Furthermore, the high quality and aesthetics of a metal casket are often perceived to communicate a degree of respect, status and/or luxury for the deceased. Many families thus desire ornate metal caskets for the deceased, so as to present the deceased in the most esteemed manner affordable.

Unfortunately, a family may wish to present the deceased in an ornate metal casket, when they can only afford a less expensive wood casket. Alternatively, the family may wish to cremate the deceased (in a cremation box, for example), but would still like to have an ornate metal casket for a wake. It would thus be beneficial if the family of the deceased could rent the more ornate casket for presentation of the deceased, without having to purchase the ornate casket for subsequent burial or cremation.

Prior artisans have attempted to solve this problem. For example, U.S. Pat. No. 4,177,543 to Angermann discloses a display casket for removably holding a body display container. U.S. Pat. No. 5,481,785 to Minton et al. discloses a reusable casket assembly comprising a two part burial system having an ornate, reusable outer shell mated to an inner capsule. However, among other deficiencies, both Angermann and Minton et al. are not compatible with conventional containers for human remains, are cumbersome to operate, and do not include means for easy removal of the remains container.

SUMMARY OF THE INVENTION

The reusable casket disclosed herein addresses deficiencies of the prior art. Disclosed is a method for single-handedly transferring boxed human remains from a casket interior onto a preferably wheeled transport for the remains. The reusable casket preferably includes a preferably releasable casket front, a preferably releasable casket top, and preferably an interior tray and interior track assembly. These and other features facilitate both ease of operation and compatibility with conventional remains containers.

Further disclosed herein is a reusable casket including a preferably rectangular solid-configured casket body having a casket top preferably connected to the casket rear preferably with a hinge for pivotal movement between a casket-open position and a casket-closed position. The casket top is preferably in facing contact with the two ends of the casket body, and in contact with the casket front and with the casket rear, and preferably has a fabric head panel mounted in the interior of the casket top. The casket body also includes an upstanding, in one position, casket front preferably positioned generally parallel with and spaced from the casket rear. The casket front is pivotally connected to the bottom of the casket body for angular movement, preferably between a casket-closed and a casket-open position, further preferably over an arc of at least about one hundred eighty (180) degrees. The casket front is preferably in contact with the casket top when the casket top is in the casket-closed position.

The reusable casket preferably includes latching means preferably at the juncture of the casket front and the two casket ends for latchingly retaining the casket front in the casket-closed position. A handle is mounted on the exterior of the casket front for releasing the latching means, preferably in a single action. The reusable casket also includes manually actuated locking means, preferably mounted in the casket top, for securing the casket top to the casket front, when both the casket top and casket front are in their respective casket-closed positions. The locking means preferably may be operated with a single hand.

The reusable casket preferably further includes a movable interior tray for supporting a disposable cremateable container for human remains. The tray is preferably positioned above, preferably parallel and proximate to the casket bottom interior and is preferably slideably movable therealong between a first position, at which the tray is within the reusable casket, and a second position, at which the tray extends at least partially out of the reusable casket. When the casket front is in a fully open position and hence in a substantially vertical disposition and the tray is in the second position, the tray is preferably above and essentially perpendicular to the casket front. The reusable casket also preferably includes a plurality of track assemblies preferably having rollers or other rotatable members. The track assemblies are preferably connected to the bottom interior surface of the casket body. The rollers preferably have axes transverse to the preferred direction of movement of the tray laterally along the casket bottom and provide rotatable support for the tray during tray lateral movement along the casket bottom towards an open front of the reusable casket.

Means for retaining the tray in proximity to the casket bottom define the first and second positions of the tray and preferably permit a pre-selected amount of tray skew movement, manifested as slop, as the tray moves. The retaining means preferably include slotted webs that are fixedly connected to the casket bottom, with the slots being parallel with the direction of tray movement between the first and second positions. The retaining means also include at least one rod connected to the tray and resident within the slotted webs. Each rod preferably interferes with the end of the web in which the rod resides, thus defining first and second extremity positions of the tray. Suitable removable means are used to retain each rod within the slot in the slotted web in which each rod resides. These means may include cotter pins, for example.

In another aspect of the invention, the reusable casket is configured as a rectangular solid having a casket top, a casket rear, a casket front, a left casket end, a right casket end, a casket bottom, latching means, locking means, and a tray as described above, preferably together with means on the casket bottom interior for rotatably supporting the tray during tray movement along and above he casket bottom interior. A fabric head panel is preferably removably mountable in the interior of the casket top. Manually applied pressure sensitive means can be used for removably retaining the fabric head panel in position in the interior of the casket top.

Respective adjacent and adjoining the edges of the casket top, casket rear, casket front, casket bottom, and left and right casket sides are aligned and, at the casket closed position, are preferably in facing contact. In the casket-open position, the casket front can be in edge-wise alignment with the casket bottom. Further, in the casket-closed position, the casket front can be generally parallel with and spaced from the casket rear.

The reusable casket preferably includes means for retaining the tray in proximity to the casket bottom and defining the first and second positions of the tray. The tray retaining means preferably permits a pre-selected amount of skew or angular movement as the tray moves literally between the first and second extremity positions. The tray retaining means preferably, also include slotted webs fixedly connected to the casket bottom, where the slots are preferably parallel and extend in the direction of tray lateral movement between the first and second positions. The tray retaining means preferably also include at least one rod connected to the tray and residing within the slots of the slotted webs, together with means for retaining the rod within the slot.

In another aspect, the reusable casket having the preferable generally rectangular solid configuration has a casket top hingedly connected to the casket rear for pivotal movement between a casket-open position and a casket-closed position at which the casket top is in facing, edge-wise contact with two casket ends, a casket front, and a casket rear of the rectangular solid-configured casket body. The reusable casket preferably includes latching means, having a latch handle for releasing a latch. The casket front of the rectangular solid-configured exterior is pivotally connected to a casket bottom for swinging radial movement between a casket-closed position, where the front is in edge-wise contact with the casket ends, and a casket-open position, where the casket front has rotated 180° about a longitudinal axis, is still vertically oriented but is separated from the casket ends. The casket front and casket bottom are preferably connected with a piano hinge running substantially along the common adjoining length of the casket front and casket bottom.

The reusable casket also preferably includes a tray for supporting human remains and means for supporting the tray by facilitating tray movement along, and at least somewhat laterally outwardly, relative to the casket bottom. The means supporting the tray may include track assemblies with rollers, balls and/or any other suitable structure. The tray is preferably manually movable by an operator with a single hand and is desirably used for supporting a disposable crematable container for housing human remains.

The reusable casket preferably includes manually actuable lock handles preferably recessed within the pivotally movable casket front. The lock handles are preferably positioned within the casket front and are preferably hidden from view when the casket is closed and/or when the casket is covered by fabric. The lock handle of the locking means is preferably part of a mechanism, only requiring a single manual action in a single direction, which converts handle rotation about an axis into rotation of a male locking piece which effectuates release of a female locking piece retaining the casket top in the casket-closed position. The casket may further include means for converting manually applied force and resultant member displacement transversely to the casket front into unlatching rod axial movement parallel with and along the casket front, to unlatch and release the casket front.

The invention further embraces a method for single-handedly transferring boxed human remains from a casket interior onto a dolly for transport of the remains. This method preferably includes single-handedly releasing any locks securing the top of the casket to any of the casket sides. The casket is then opened preferably by raising the casket top to an open position by manually rotating the casket top about a hinged connection with the casket rear. Next, one may preferably single-handedly move a handle, which is preferably connected to the casket front, along a single direction of movement, from a latched position to a release position. This releases latches retaining the casket front in edge-wise contact with edges of respective upstanding ends of the casket.

In the method for transferring remains, one may preferably single-handedly rotate the released casket front away from the edges of the upstanding ends. The casket front preferably rotates about the pivotal connection with the casket bottom preferably through an angle of at least about ninety (90) degrees. Next, one preferably single-handedly slides a moveable tray, inside the casket and supporting the boxed remains, laterally on transversely oriented track assemblies located along the casket bottom interior. The tray moves laterally or transversely (relative to the lengthwise direction of the casket defined by the two casket ends) from a position fully within the casket to a position at which the tray extends outwardly and at least partially overlies the downwardly hanging casket front. One may then easily single-handedly move the boxed human remains slidably off the tray, on to an adjacent transport dolly.

Figure 24:
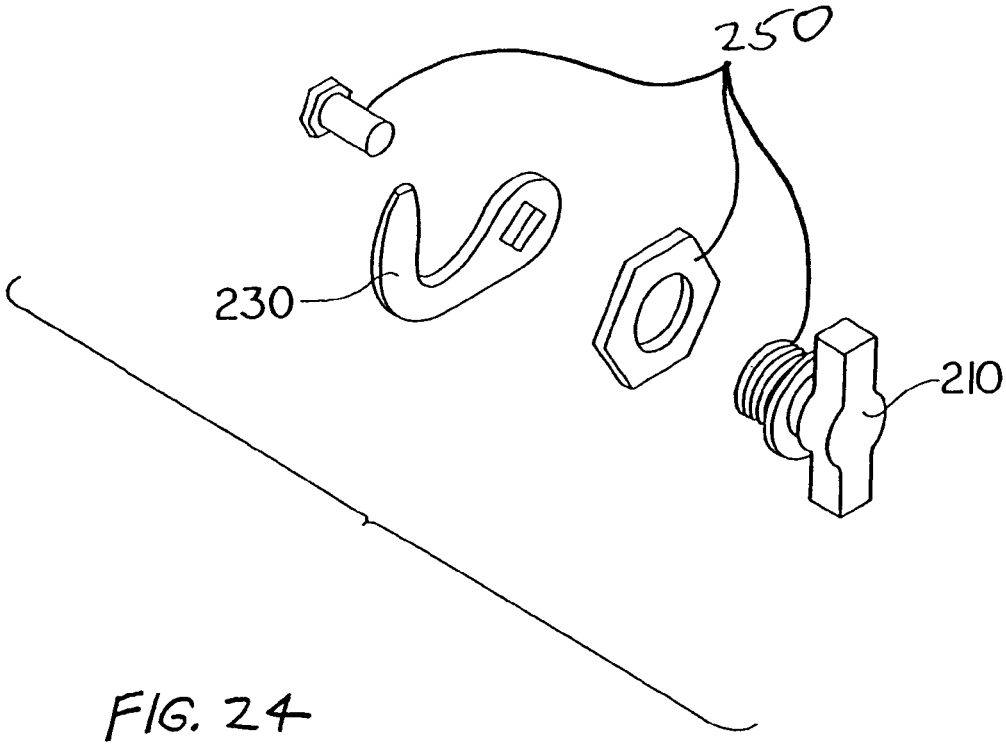
FIG. 24 is an exploded perspective view of a portion of the manually-actuable locking means.
Figure 25:
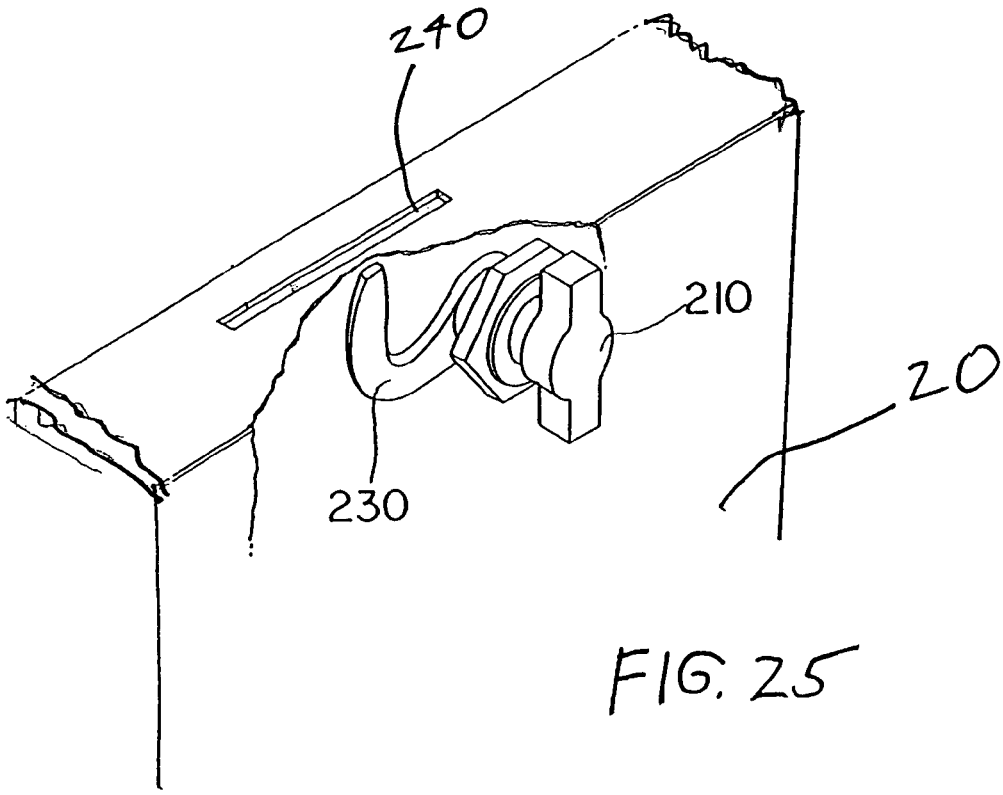
FIG. 25 is a partially-broken perspective view of the manually-actuable locking means shown in FIG. 24.

FIG. **26*a* is a front view showing the manually-actuable locking means shown in FIGS. 24 and 25** in a locking position, securing the casket top to the casket front and with the female locking piece and front casket slot shown together to represent close alignment.

Figure 26A:
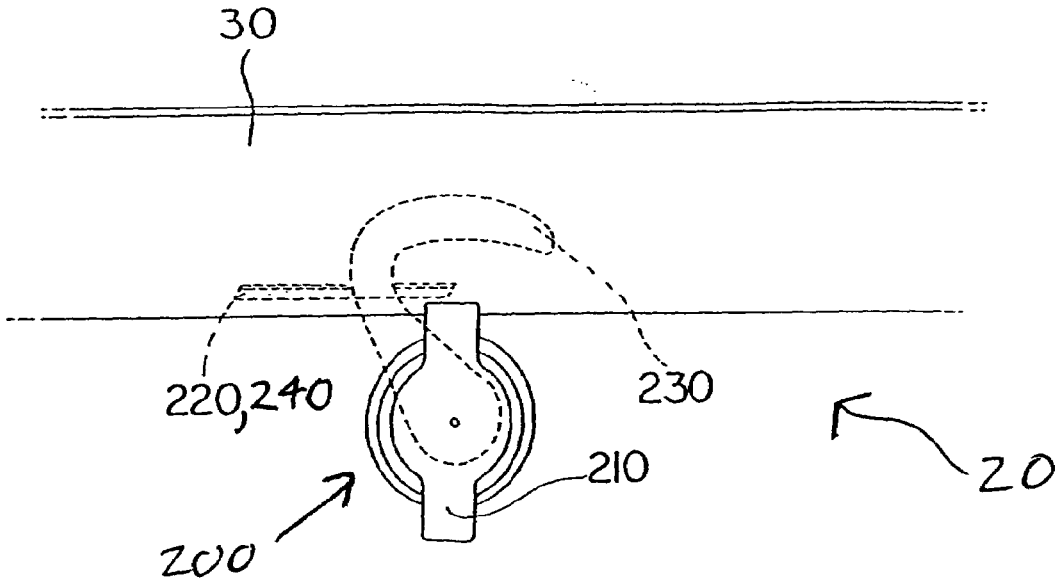
Figure 26B:
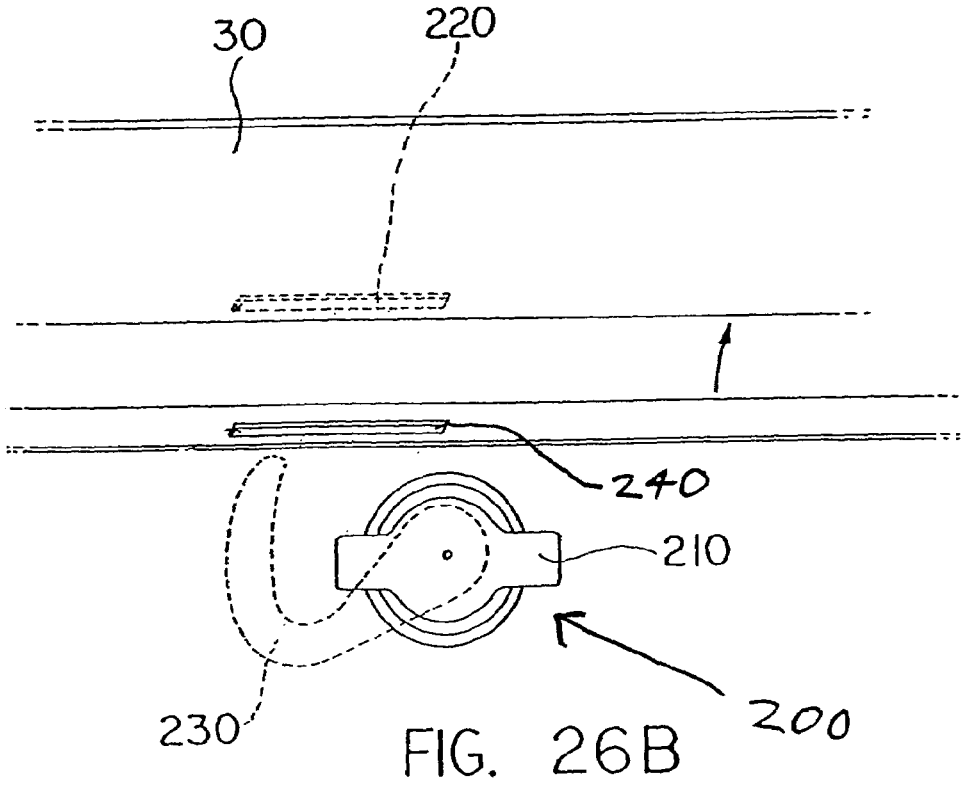

FIG. **26*b* is a front view showing the manually-actuable locking means shown in FIG. 26*a*** in an open position, so that the casket top may be lifted away from the casket.

Figure 27:
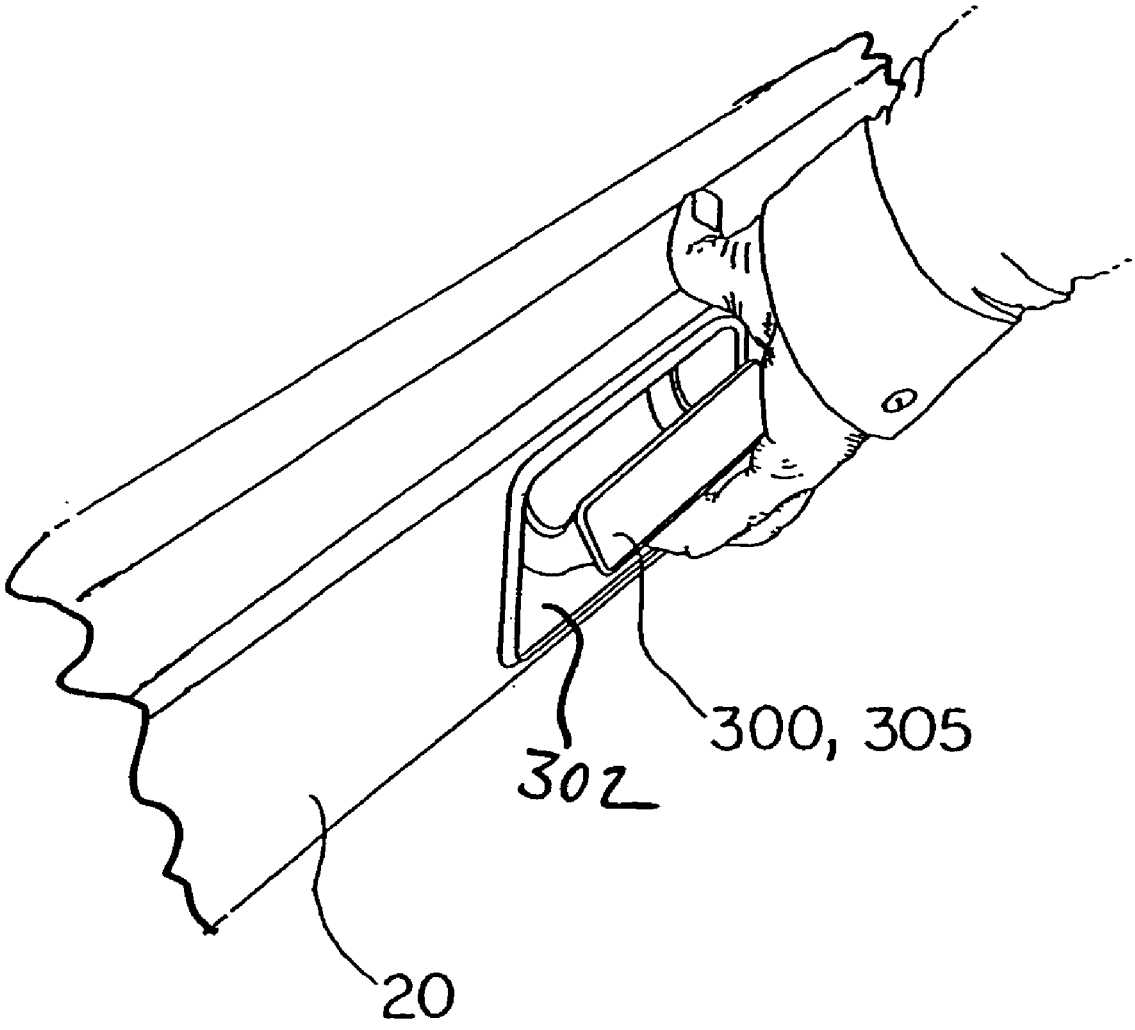

FIG. 27 is a perspective view of a handle for releasing a latching mechanism which secures the casket front in the casket closed position, with the casket front in contact with the casket ends.

Figure 28:
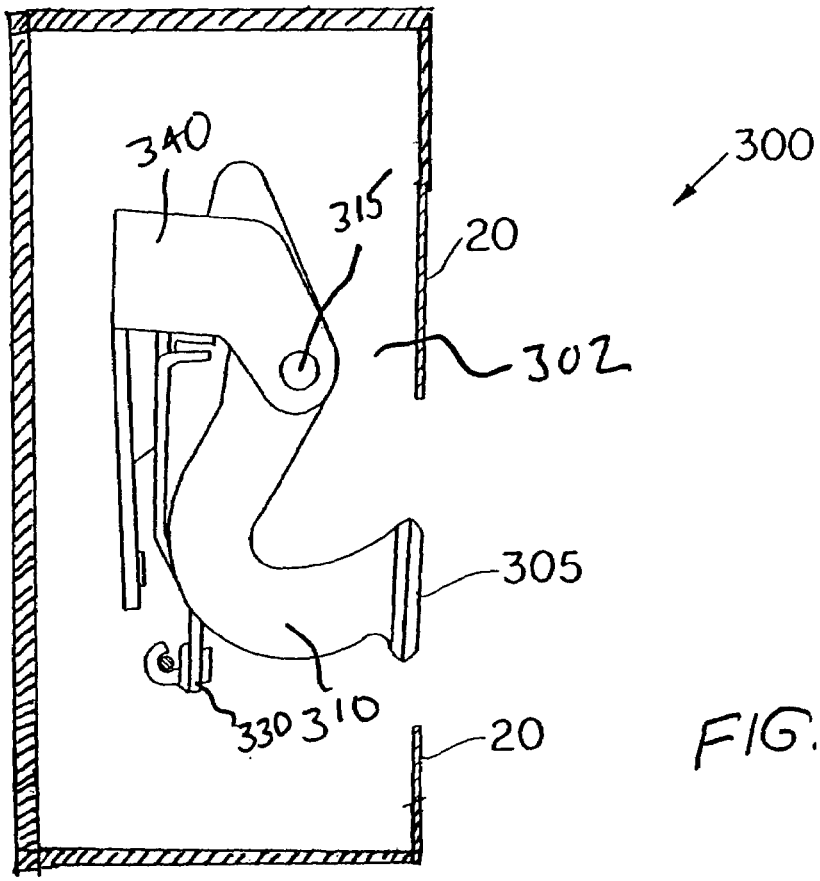

FIG. 28 is a side view of the handle illustrated in FIG. 27 with the handle in a latching mechanism-closed position and shown in a recess of the casket front.

Figure 29:
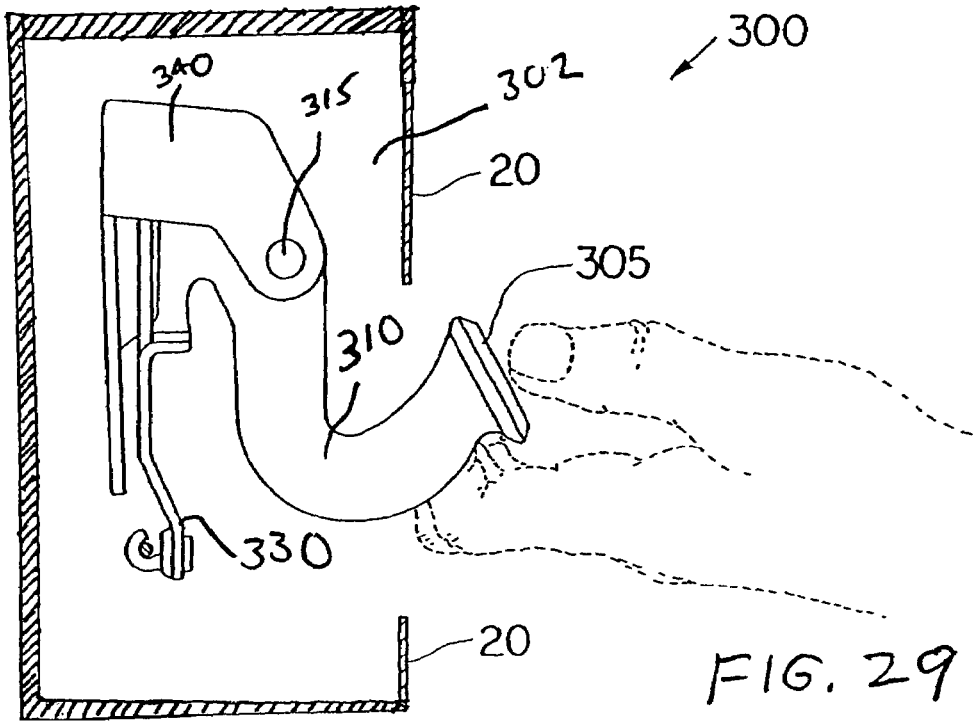

FIG. 29 is a partially-sectional side view showing the handle illustrated in FIG. 27 with the handle having been moved to a latching mechanism-open position.

Figure 30:
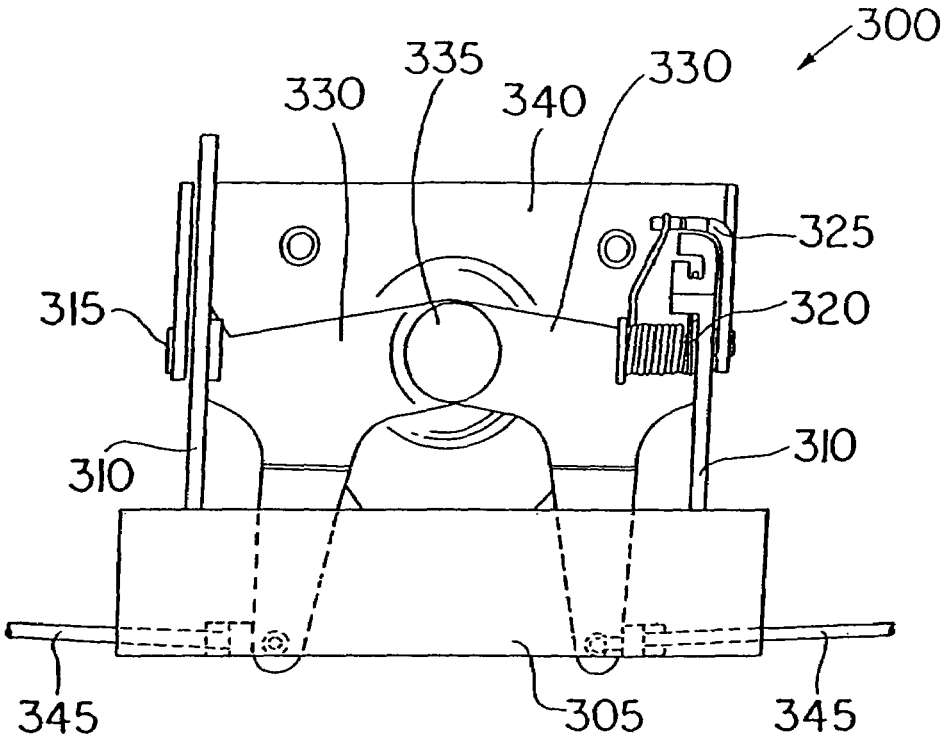

FIG. 30 is a front partial view of another part of a latching mechanism, portions of which are illustrated in FIGS. 27 through 30, with the latching mechanism shown in a closed or latched position.

Figure 31:
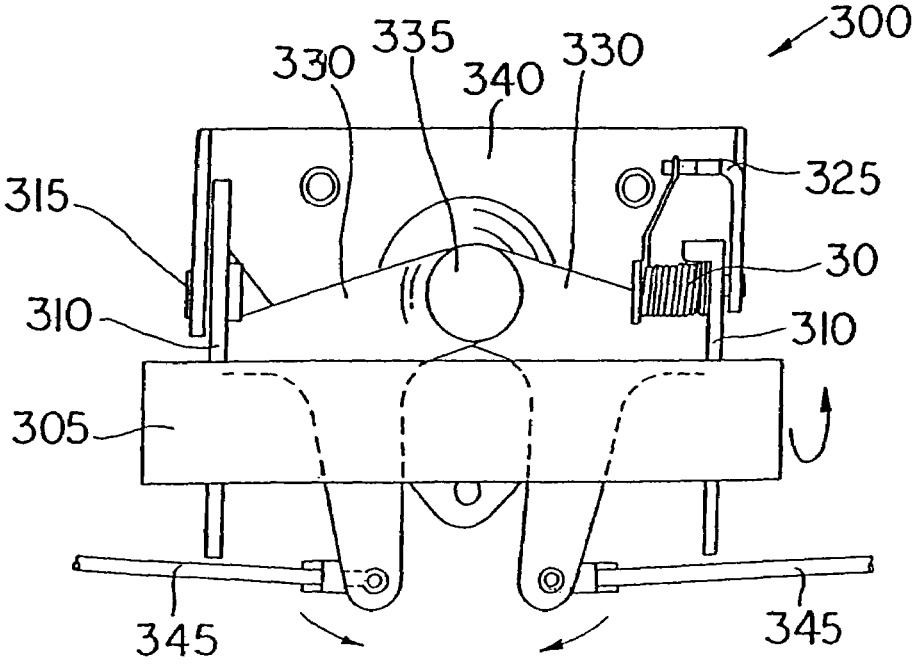

FIG. 31 is a front partial view similar to FIG. 30 but with the latching mechanism being shown in an open position.

Figure 32:
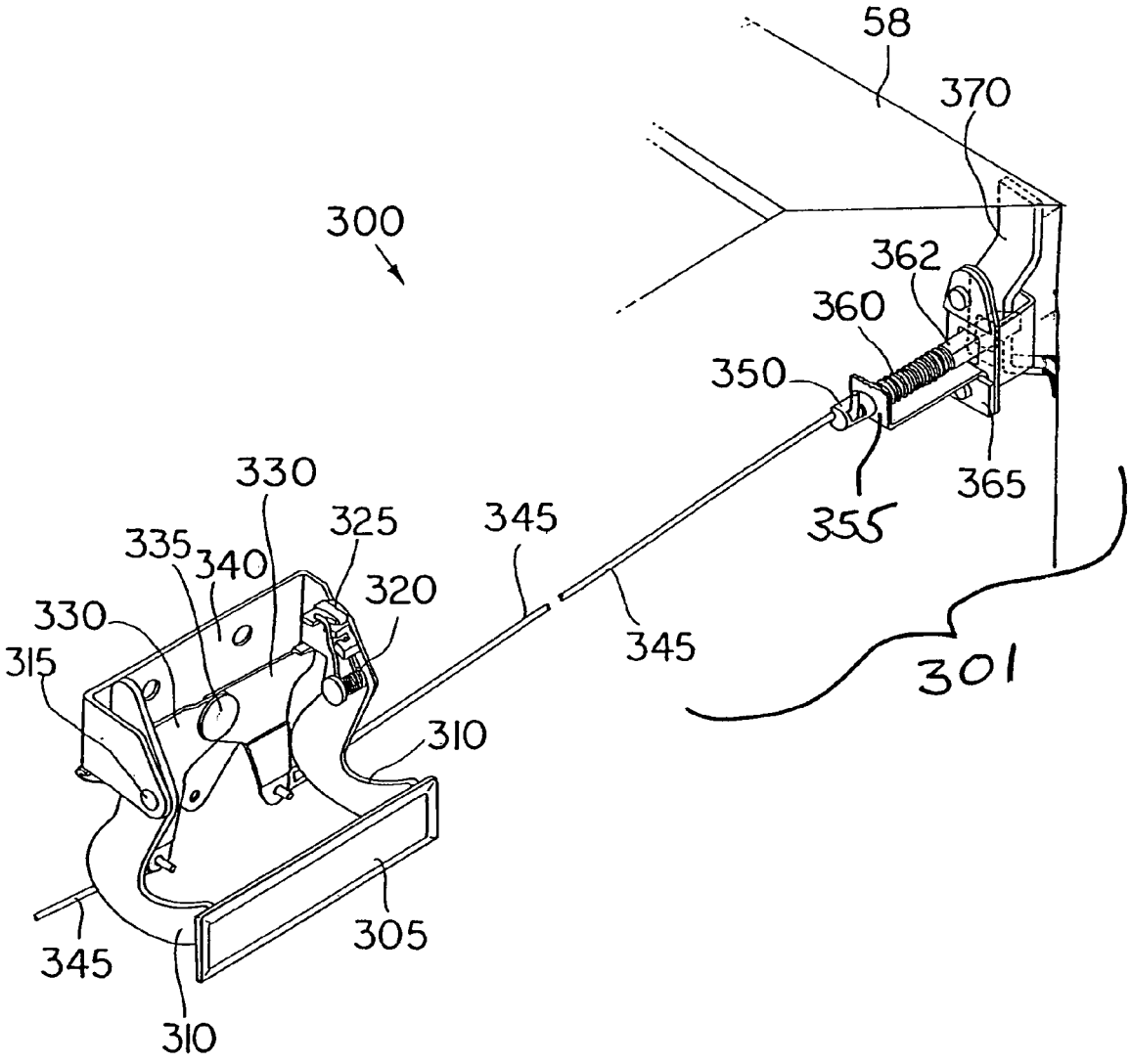

FIG. 32 is an isometric view of the latching parts of which are illustrated in FIGS. 27 through 31 with the latch mechanism being shown in a latch-closed position, with only one of two latches shown for purposes of drawing clarity.

Figure 33:
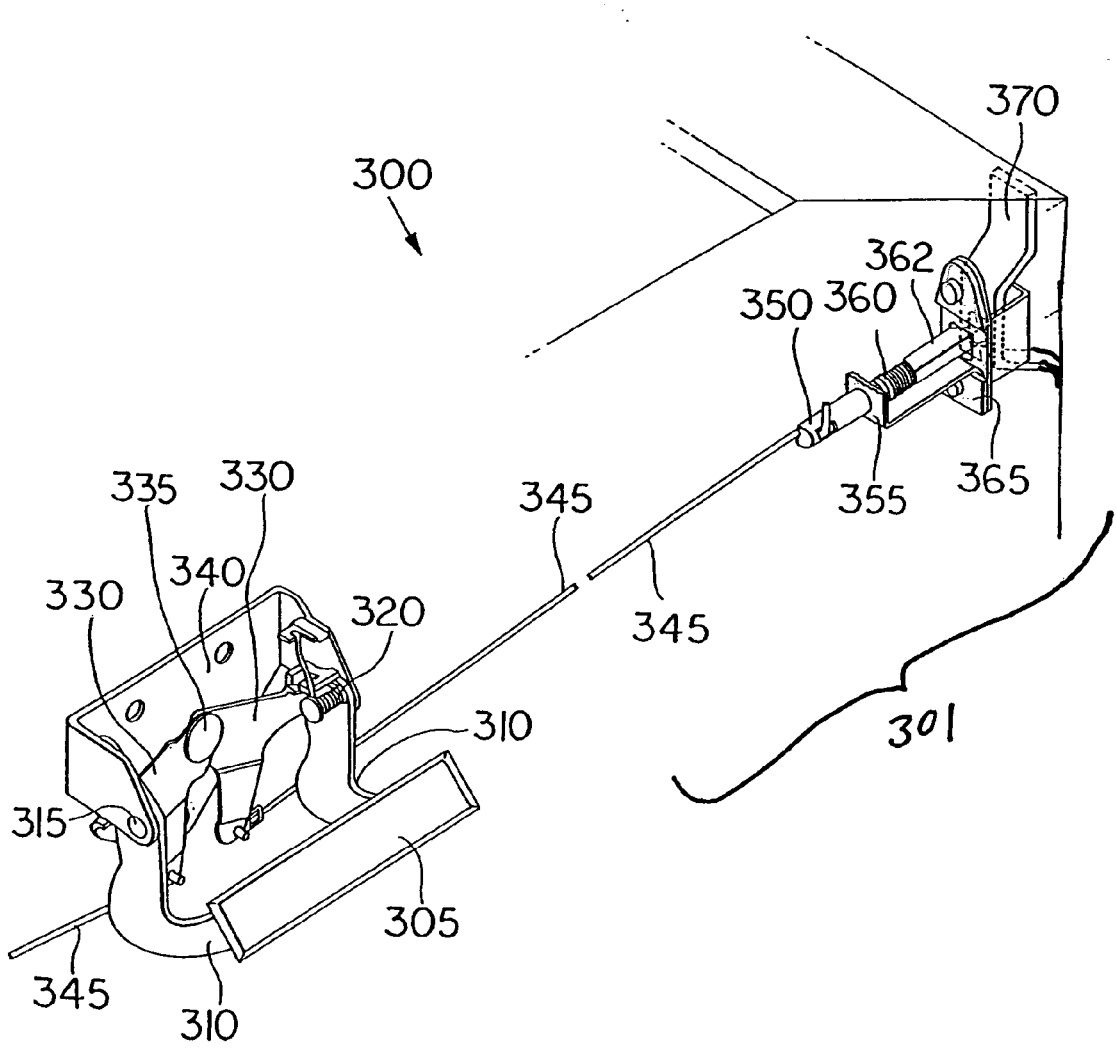

FIG. 33 is an isometric view similar FIG. 32 with the latch mechanism being shown in a latch-open position.

DESCRIPTION OF THE PREFERRED EMBODIMENTS AND BEST MODE KNOWN FOR PRACTICING THE INVENTION

FIGS. 1 through 9 illustrate a reusable casket, designated generally 10, in accordance with a preferred embodiment of the invention. Reusable casket 10 is preferably in the form of a generally rectangular solid-configured body, preferably made from twenty-gauge steel, having a casket front 20, a casket top 30, a casket rear 40, a casket bottom 50, a left casket end 54 and a right casket end 58. The edges of left casket end 54, right casket end 58, and casket rear 40 are securely attached to the edges of casket bottom 50 by welding and/or other suitable means. The edges of the left casket end 54 and right casket end 58 are also securely attached to the edges of casket rear 40 by welding and/or other suitable means. The bottom exterior surface of casket bottom side 50 is preferably essentially planar to rest securely on a conventional dolly.

As principally shown in FIGS. 5 through 9, casket top 30 is preferably attached to casket rear 40 with hinges 60 and attached to left casket end 54 and right casket end 58 by gas shocks 65, which are shown to be covered with fabric to enhance the visual presentation of reusable casket 10. Hinges 60 are preferably made of a strong, resistant polyester, but can be constructed of any suitable material. As shown, a fabric head panel 35 is preferably secured in the interior of casket top 30. When in the closed position, casket top 30 is releasably connectable to casket front 20 via manually-actuable locking mechanisms designated generally 200 and shown in FIGS. 1 and 5. Locking mechanism 200 shall be discussed in greater detail below with principal reference to FIGS. **24-26*b***.

Figure 9:
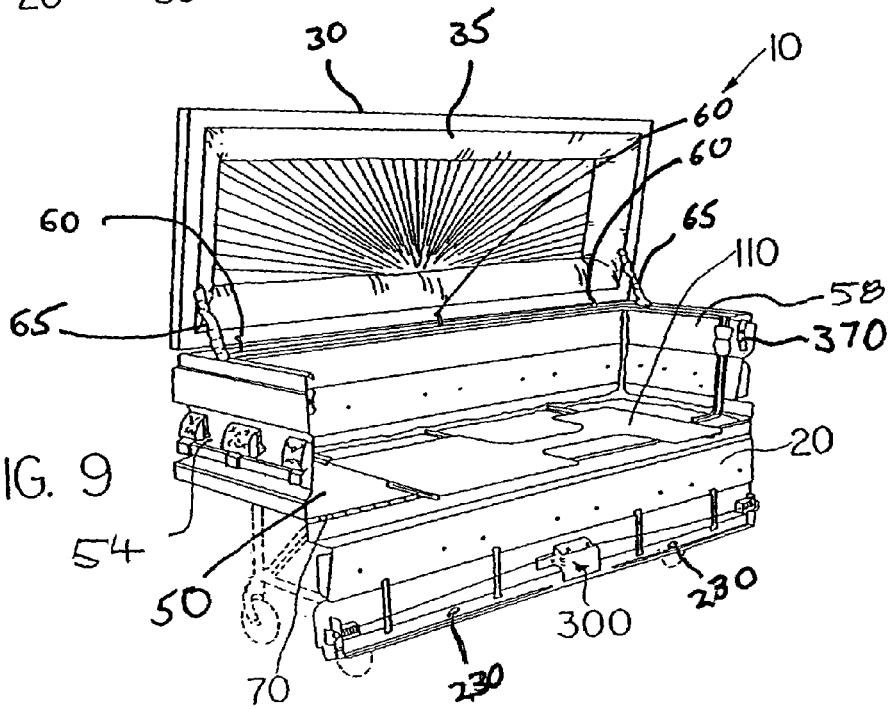
FIG. 9 is a corner isometric view of the reusable casket illustrated in FIGS. 1 through 8 showing the casket front in a fully-open position (180° rotation), a tray in at least partially laterally extended position, and the box for containing remains removed from the tray.
Figure 10:
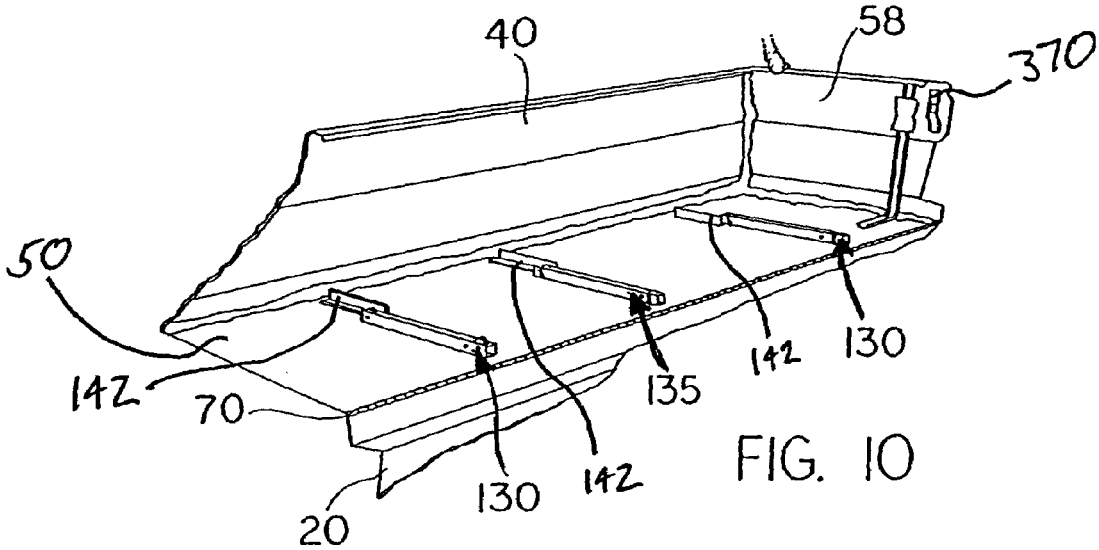
FIG. 10 is a partially-broken isometric view of the interior of the reusable casket shown in FIGS. 1 through 9 with track assemblies mounted on the bottom interior of the casket being visible.
Figure 11:
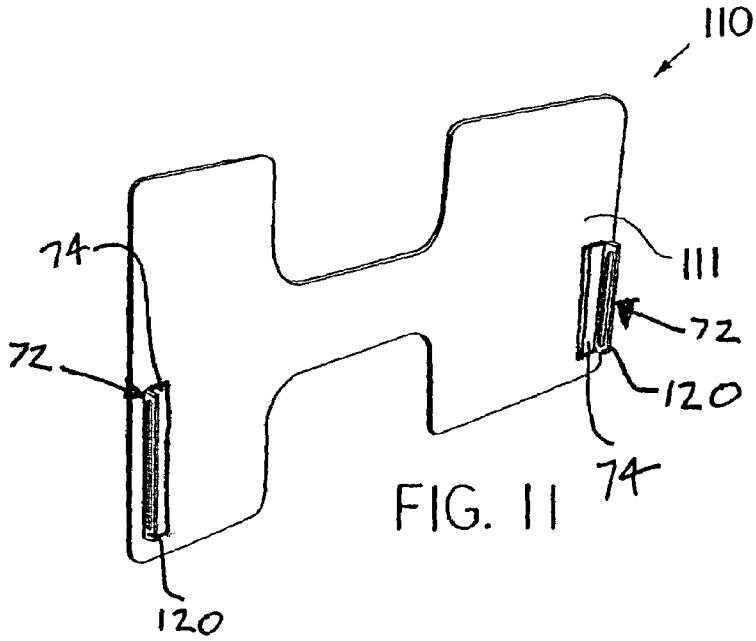
FIG. 11 is a perspective view of a tray forming a part of the casket shown in FIGS. 1 through 10.

As principally shown in FIG. 9, casket 10 is shown with casket front 20 in an open position to expose a latching mechanism designated generally 300. Casket front 20 is releasably secured in a closed position to left casket end 54 and right casket end 58 via latching mechanism 300. Casket front 20 is connected to casket bottom 50 via piano hinge 70 and is releasably connected to casket top 30 via locking mechanisms 200 the mule locking pieces 230 of locking mechanism 200.

Figure 1:
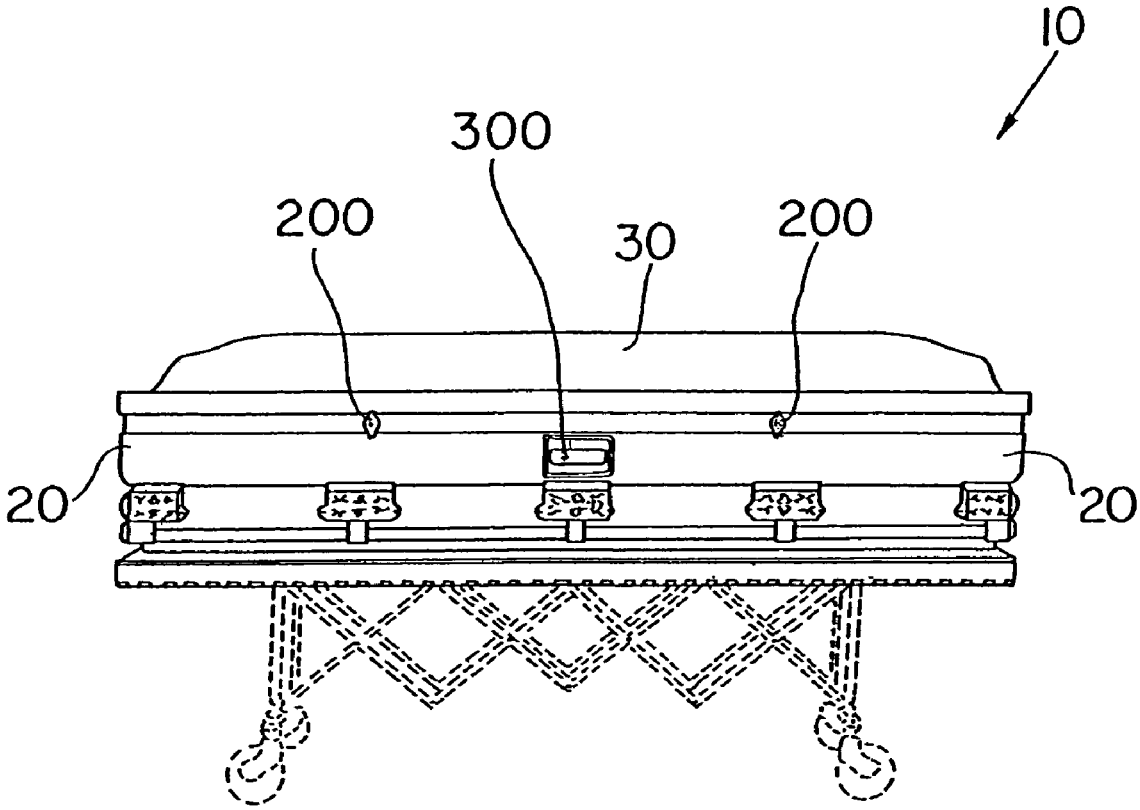
FIG. 1 is a front view of a reusable casket in accordance with the preferred embodiment of the invention having a casket top in a closed position, with the reusable casket being shown on a table cart, illustrated in dotted lines, which is not part of the invention.
Figure 2:
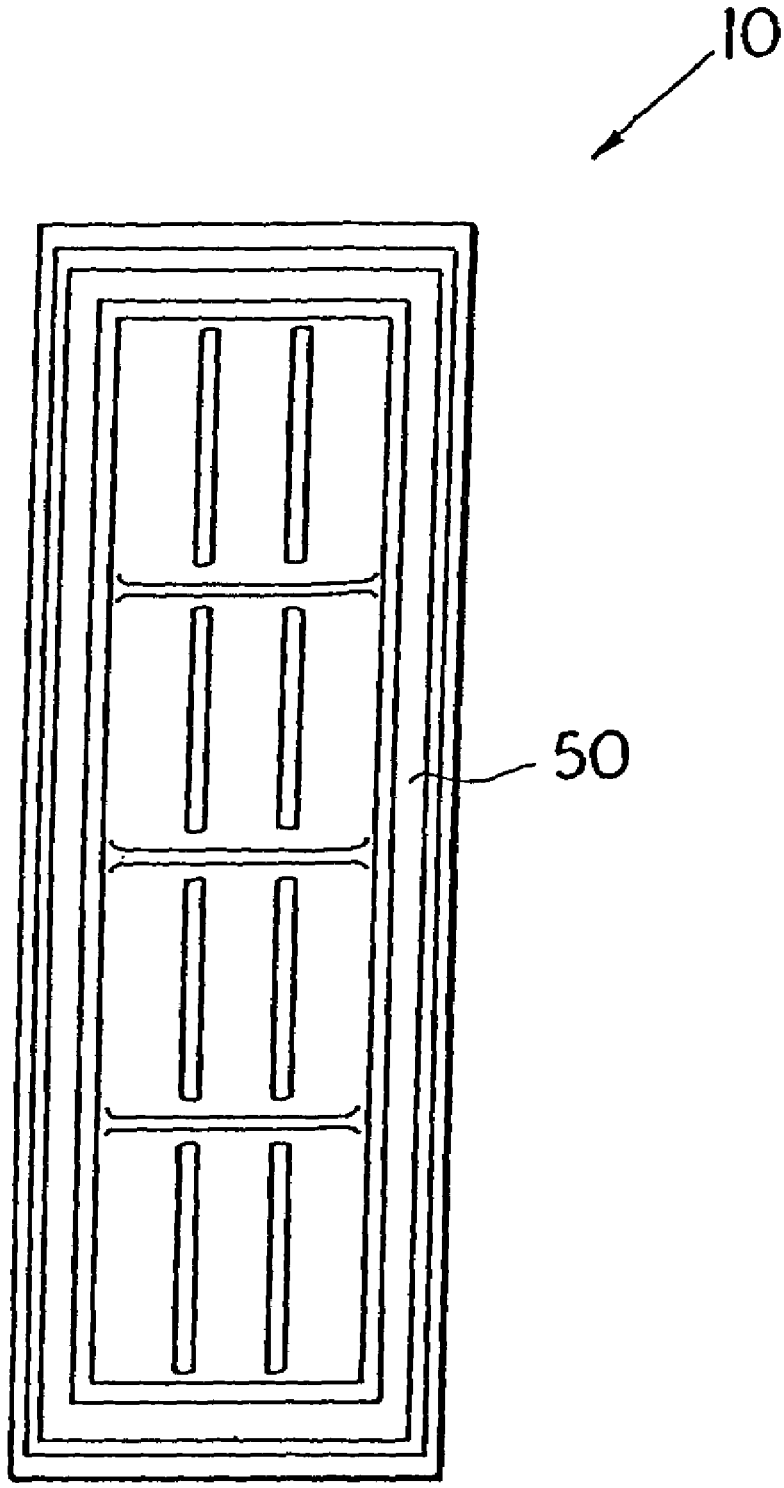
FIG. 2 is a bottom view of the reusable casket shown in FIG. 1, removed from the table cart, with the casket front to the right.
Figure 3:
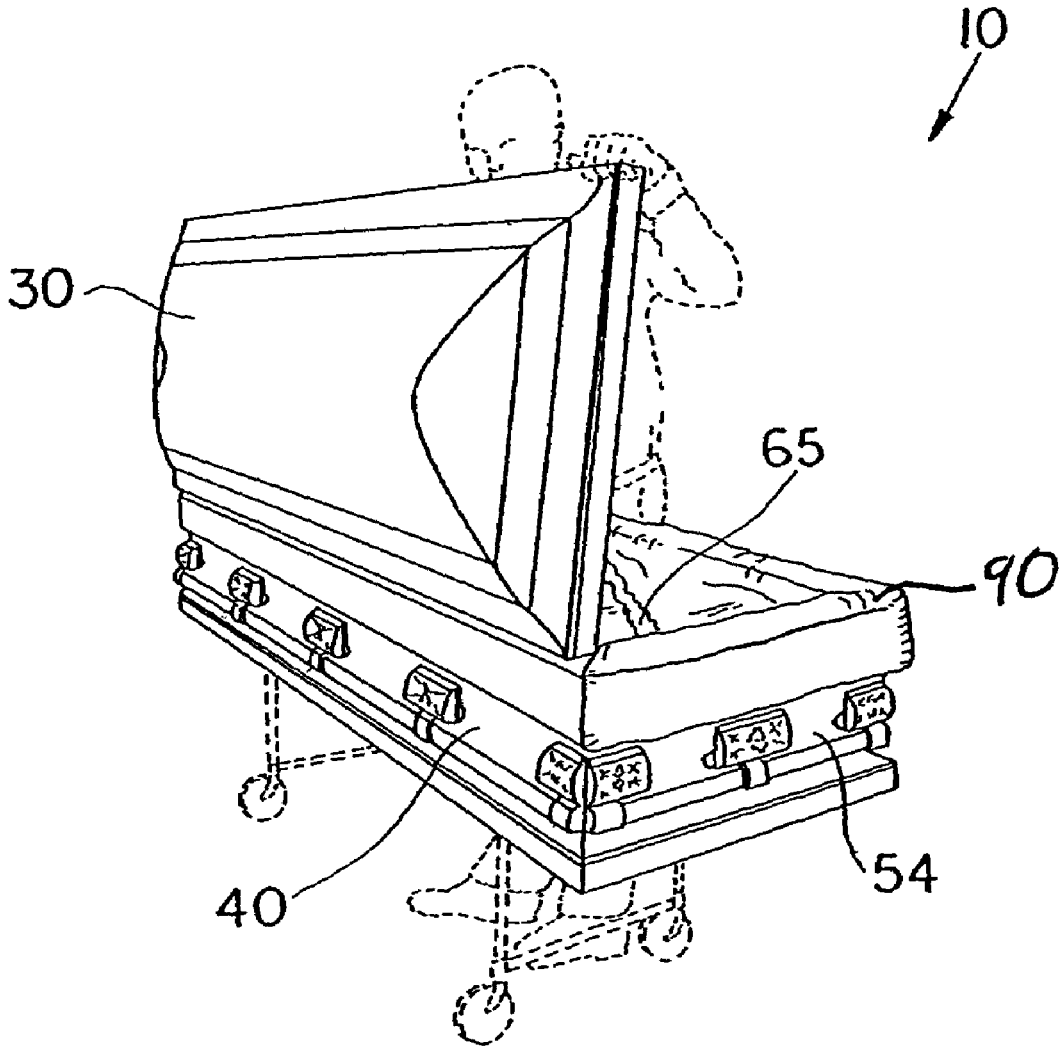
FIG. 3 is a perspective view of the reusable casket shown in FIGS. 1 and 2 with the casket top in an open position, with the reusable casket again being shown resting on a table cart which is not part of the invention.
Figure 4:
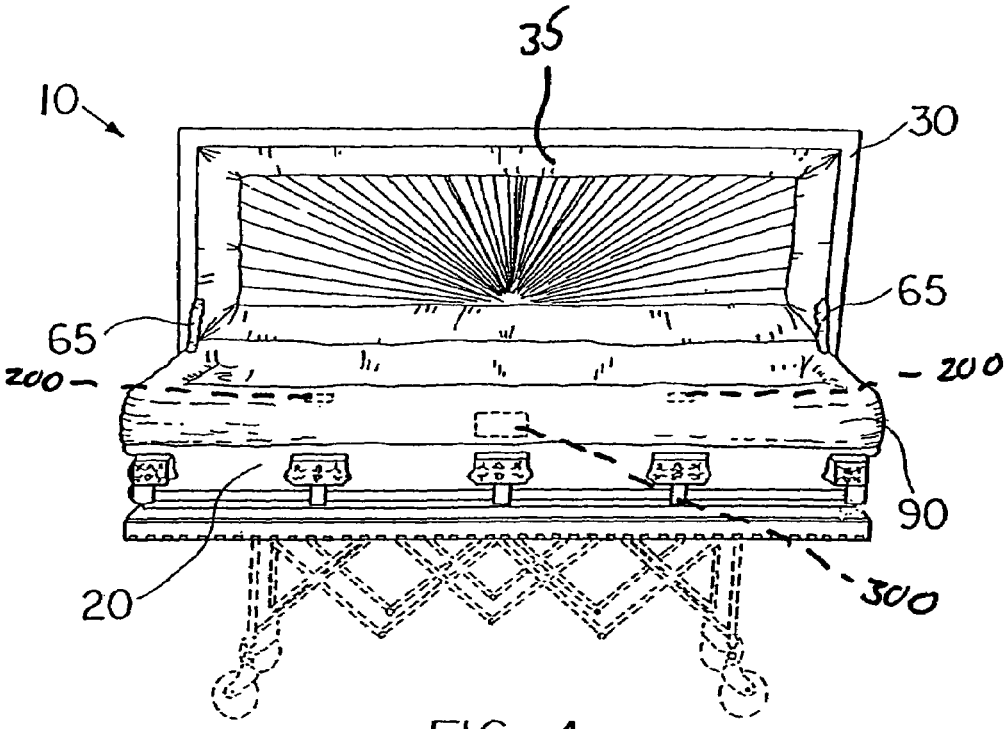
FIG. 4 is a front perspective view of the reusable casket shown in FIGS. 1 through 3, with the reusable casket again being shown resting on a table cart which is not part of the invention.
Figure 6:
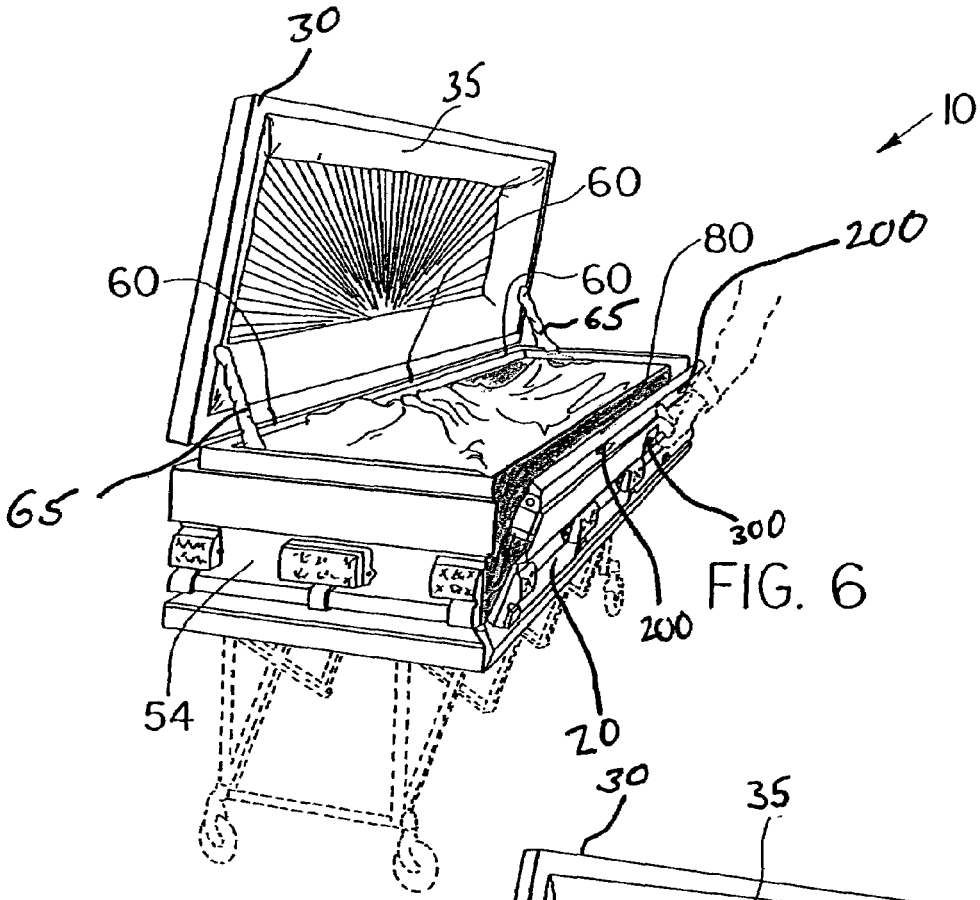
FIG. 6 is corner perspective view of the reusable casket shown in FIGS. 1 through 5 with the casket front shown in a slightly open position and with the reusable casket again shown resting on a table cart which is not part of this invention.
Figure 7:
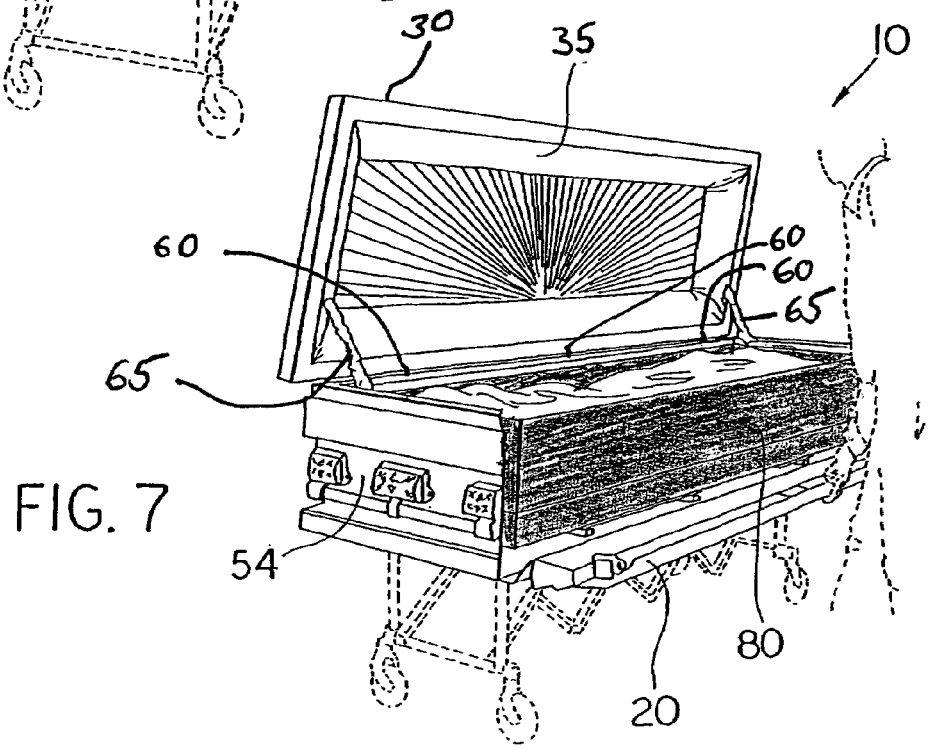
FIG. 7 is a corner perspective view of the reusable casket shown in FIGS. 1 through 6 with the casket front in a partially-open position (90° rotation) and with the reusable casket again being shown resting on a table cart which is not part of this invention.
Figure 8:
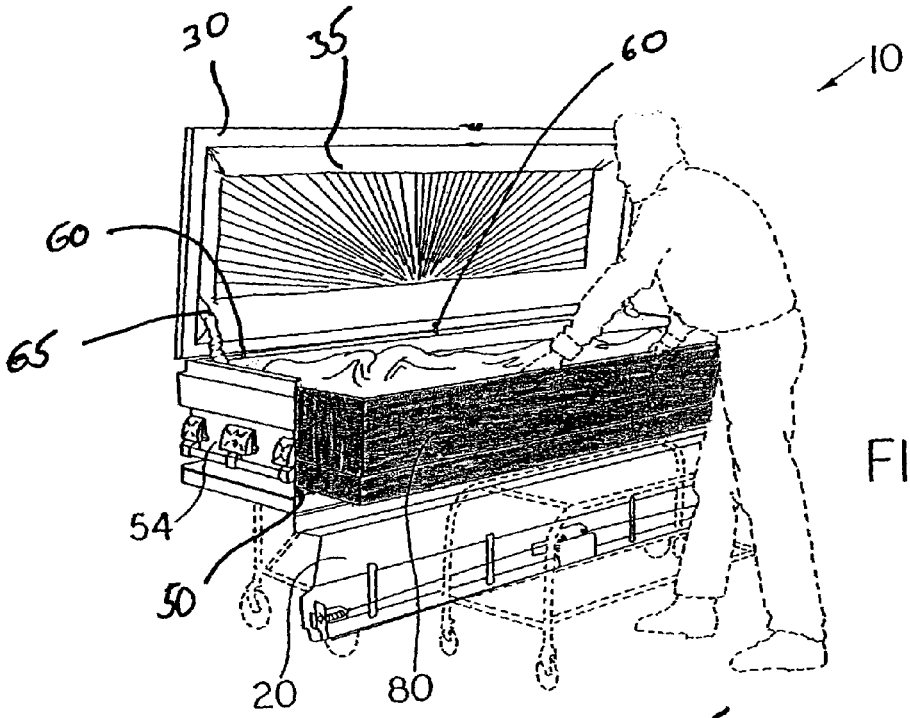
FIG. 8 is a corner isometric view of the reusable casket illustrated in FIGS. 1 through 7 with the casket front in a fully-open position and a box for containing remains resting on a tray which is in a retracted position within the reusable casket, with the reusable casket again being shown resting on a table cart which is not part of this invention, and with a dolly which is not part of this invention.

As principally shown in FIGS. 6 through 8, casket 10 may optionally contain a box 80. Box 80 is large enough to receive human remains oriented in a prone position but small enough to fit inside casket 10. As shown in FIG. 4, fabric 90 may be used for covering the top edges of box 80, casket front 20, casket rear 40, left casket end 54, right casket end 58, and any gaps between reusable casket 10 and box 80. Box 80 is preferably constructed of wood, cardboard, or any other suitable preferably flammable material which burns leaving little or no ash, to facilitate cremation of any remains contained therewithin. Other fabric or the same fabric may be used to cover any remains in box 80.

With principal reference to FIGS. 10 through 23, casket 10 includes a tray, designated generally 110, and a plurality of track assemblies each designated generally 130. Each track assembly 130 is preferably mounted on the interior surface of casket bottom 50 and extends perpendicularly to piano hinge 70 defining juncture of casket front 20 with casket bottom 50. Tray 110 preferably lies on rollers 150 which define the upper extremities of the plurality of track assemblies 130. When present, optional box 80 lies on top of tray 110. Preferably, tray 110 is formed of a steel plate 111 having a thickness of about one-eighth of an inch (⅛") and is securely attached to a plurality of preferably steel angle member each of which is designated generally 72 in the drawings and are particularly well shown in FIGS. 17 and 18. Each angle member 72 has a horizontal portion 74 which is preferably welded to the under side of steel plate 111 forming a portion of tray 110 and further includes a vertical web portion 120 having a longitudinally elongated slot 125 formed therein. Each web 120 includes longitudinally elongated slots 125.

Figure 16:
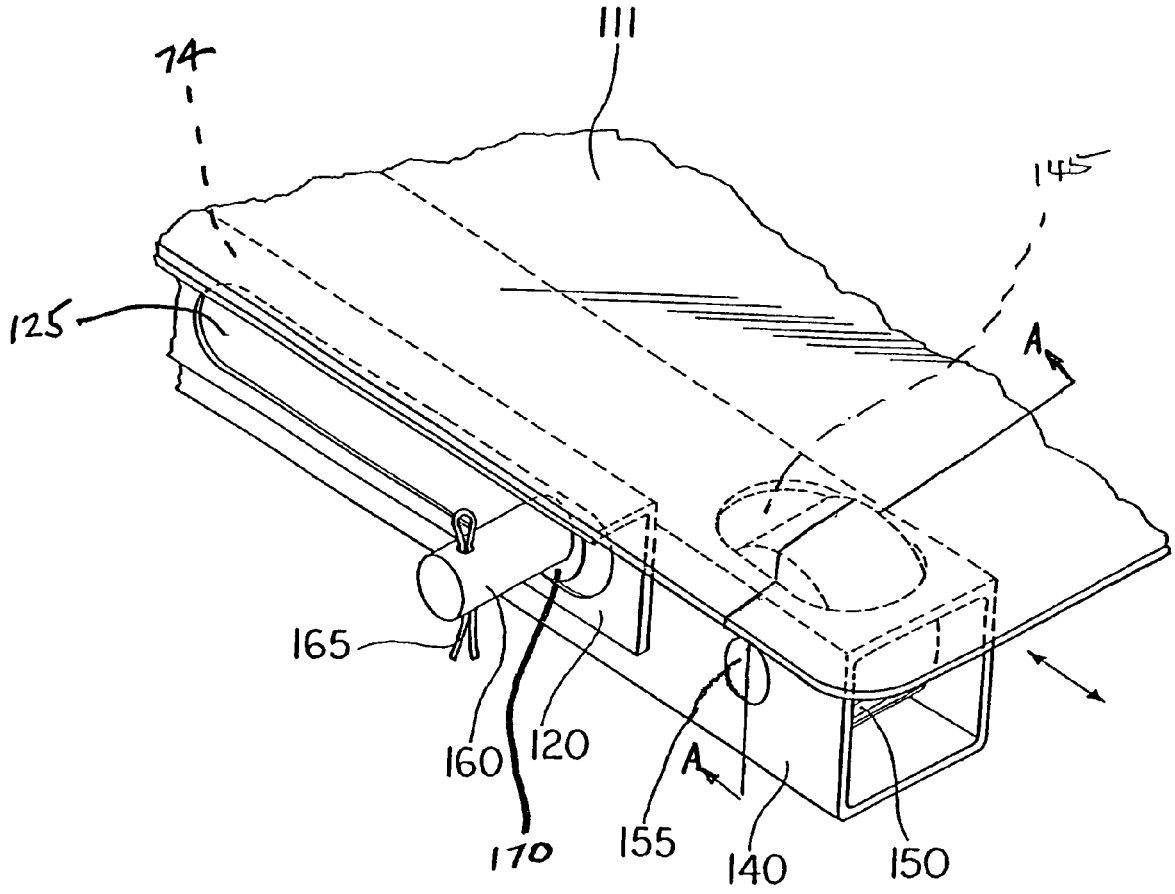
FIG. 16 is a broken isometric view showing the track assembly shown in FIG. 10 with the tray as shown in FIGS. 11 through 15.
Figure 17:
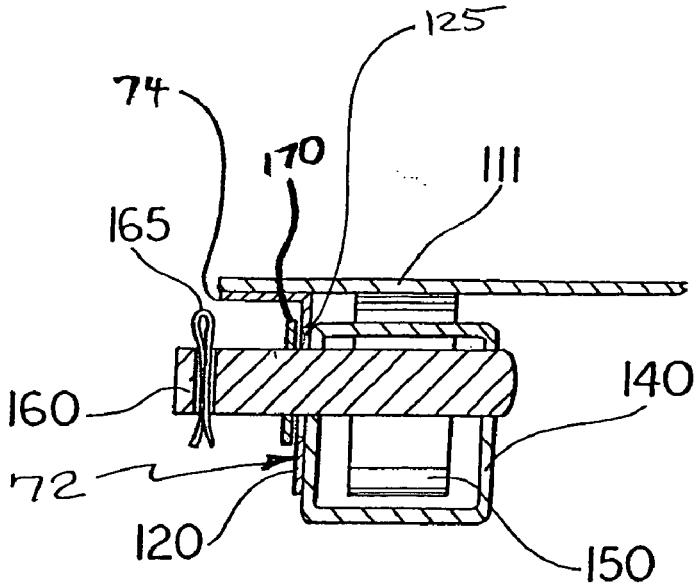
FIG. 17 is a sectional front view taken at lines and arrows A-A in FIG. 16 of the tray and track assembly shown in FIG. 16.
Figure 18:
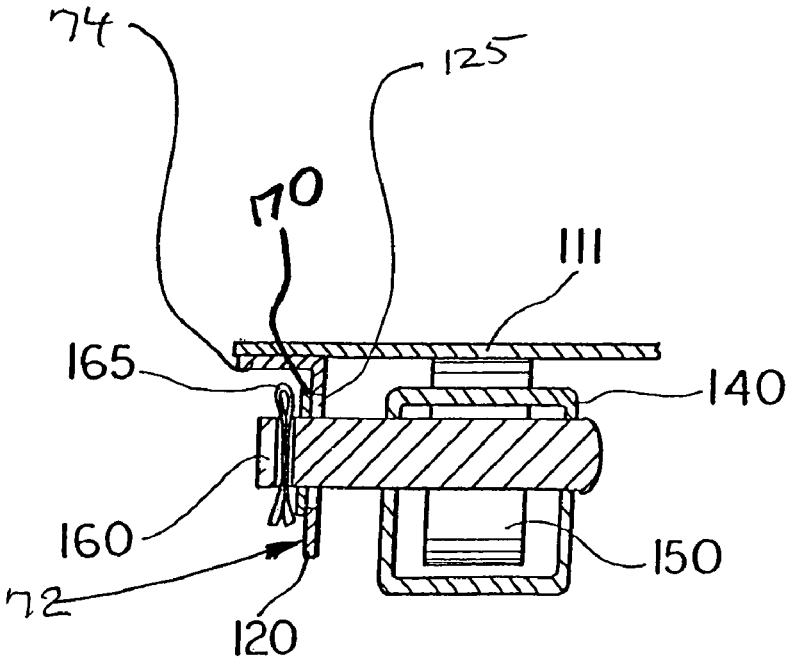
FIG. 18 is sectional front view showing another position of the tray and track assembly relative to that shown in FIG. 17.
Figure 19:
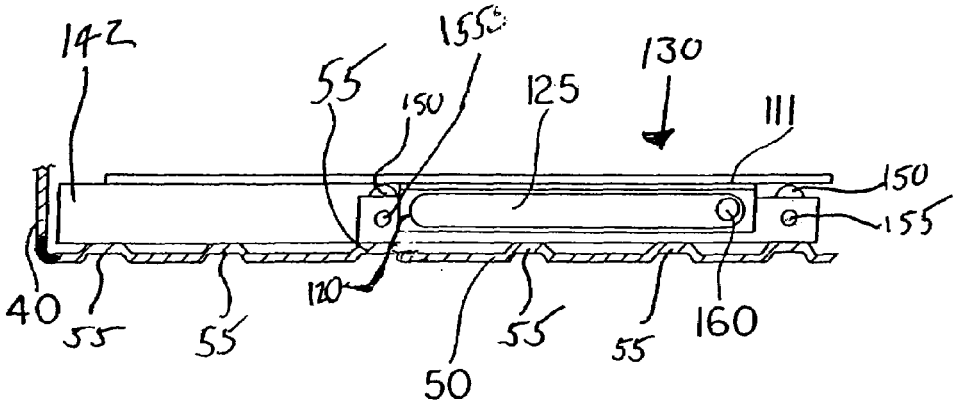
FIG. 19 is a side view of a track assembly and tray of FIG. 16, looking in the direction of arrow 19 in FIG. 12, with the ridges of the casket bottom being shown and with the tray shown in a partially retracted position.

FIGS. 16 through 18 illustrate track assembly 130 in greater detail. Each track assembly 130 preferably includes an elongated hollow rectangular cross sectioned runner 140, a plurality of rollers 150, a plurality of roller axes 155, a plurality of rods 160, a plurality of cotter pins 165 and washers 170. Each elongated hollow rectangular cross sectioned runner 140 is mounted to the interior of casket bottom 50 preferably by welding, is preferably perpendicular to the plane of casket rear 40 and parallel to the plane of casket left side 54 and casket right side 58, and is of a length equal to about one-half the transverse width of casket bottom 50. Each elongated hollow rectangular cross sectioned runner 140 is at least partially hollow as shown in FIGS. 17 and 18, with elliptical bores 145 through the top of each elongated hollow rectangular cross sectioned runner 140 proximate the ends thereof. One such elliptical bore 145 is illustrated in FIG. 16. A center track assembly 135 is also provided for supporting tray 110, which, as shown, does not engage with any slotted webs 120 in order to allow rotational motion of tray 110.

Continuing with principal reference to FIGS. 16 though 18, rollers 150 are preferably axially attached at least to the ends of each elongated hollow rectangular cross sectioned runner 140 via roller axes 155. Each roller is positioned within an end of elongated hollow rectangular cross sectioned runner 140 so that a portion of roller 150 protrudes up through bore 145. Roller axis 155 passes through the center of roller 150; each end of roller axis 155 is secured to the sides of elongated hollow rectangular cross sectioned runner 140. Each roller 150 preferably protrudes from an associated elongated hollow rectangular cross sectioned runner 140 through bore 145 a distance substantially equal to the distance every other roller 150 protrudes from an associated elongated hollow rectangular cross sectioned runner 140. Steel plate 111 thus makes even contact with each of rollers 150 when tray 110 lies undisturbed on the tops of rollers 150. As principally shown in FIGS. 10, 22 and 23, a support piece 142 is preferably parallel to elongated hollow rectangular cross sectioned runner 140 to provide additional support to tray 110. Each elongated hollow rectangular cross sectioned runner 140 and support piece 142 is supported along ridges 55 formed at least on the inside surface of casket bottom 50.

Tray 110 is securely attached to a plurality of slotted webs 120. In turn, each slotted web 120 is secured to a track assembly 130. Rod 160 protrudes from and is perpendicular to elongated hollow rectangular cross sectioned runner 140. Rod 160 extends through slot 125 of slotted web 120. A hole passes through the diameter of rod 160 at the rod end which is outside the area enclosed by tray 110 and elongated hollow rectangular cross sectioned runner 140. Cotter pin 165 passes through the hole. Cotter pin 165 is preferably longer than the width of slot 125 to prevent slotted web 120 from sliding off rod 160. The width of slot 125 is preferably greater than the diameter of rod 160. Washers 170 encircle rod 160 and come in abutting contact with cotter pin 165 during rotary motion of tray 110 in a horizontal plane.

As principally shown in FIGS. 24 through **26*b*, a preferred manually-actuable locking mechanism for locking casket top 30 to casket front 20 is illustrated and designated generally 200. Locking mechanism 200 includes a lock handle 210, a male locking piece 230, a female locking piece 220 and a fastener assembly 250, which can include any suitable means known in the art, however a nut and bolt assembly is preferred. Male locking piece 230 is preferably secured to casket front 20 via fastener assembly 250 and preferably has a portion connecting lock handle 210 to male locking piece 230 along a common axis. Casket front 20 preferably comprises a casket front slot 240 in which male locking piece rotates up actuation of lock handle 230. Casket top 30 preferably comprises a slot that forms female locking piece 220. In the closed position male locking piece 230 extends both through casket front slot 240 and female locking piece 220 to lock casket top 30 against casket front 40. In alternate embodiments, female locking piece 220 comprises a metal loop extending downward from casket top 30**.

Referring to FIGS. 27 through 33, a preferred latching mechanism for latching casket front 20 to left casket end 54 and right casket end 58 is illustrated and designated generally 300. Latching mechanism 300 includes a latch handle 305, two handle arms 310, a free pivot 315, a resistance pivot 320, a stop plate 325, a plurality of stirrups 330, a stirrup pivot 335, a mount plate 340 and a plurality of extension rods 345, as well as other components discussed below. Latching mechanism is positioned within a recess 302 of casket front 20.

As principally shown in FIG. 32, a handle arm 310 is attached at each end of latch handle 305. Handle arm 310 is pivotally attached to mount plate 340 via free pivot 315 having minimal resistance. Handle arm 310 is pivotally attached to mount plate 340 via a resistance pivot 320 and has an end opposite handle 305 that is in forced contact with stop plate 325 due to the spring force of resistance pivot 320.

Stop plate 325 is secured to mount plate 340. Handle arms 310 are pivotally attached to mount plate 340. Mount plate 340 is preferably attached to front 20 within recess 302 plurality of screws or other suitable fastening means.

Continuing with principal reference to FIG. 32, two stirrups 330 are attached to mount plate 340 by a shared central stirrup pivot 335. The ends of handle arms 310 opposite handle 305 lie above each of stirrups 330. There is a hole through the bottom end of each stirrup 330 and a latching rod 345 is fastened to each stirrup 330 at the hole. A first extension rod 345 extends towards left casket end 54 from left stirrup 330 and a second extension rod 345 extends towards right casket end 58 from right stirrup 330. At each of left casket end 54 and right casket end 58 is a male latching rod 350, a support plate 355, a spring 360, a female latching plate 365, and a bracket 370.

Now will be described a right portion of latching mechanism 300, designated generally 301, the left portion being a mirror image thereof. Female latching plate 365 runs vertically and is parallel to the left casket side 54 and right casket side 58 and has a central opening. Support plate 355 is for supporting male latching rod 350 and is preferably secured to the female latching plate 365 via screws. Support plate 355 extends horizontally from female plate 365. At the end of support plate 355 opposite female latching plate 365, support plate 355 then extends vertically so that a vertical portion faces female latching plate 365. The vertical portion contains a central opening that lines up with the opening of female latching plate 365. Support plate 355 and female latching plate 365 are secured to the inside surface of casket front 20. Bracket 370 is secured to right casket end 58 and the opening of bracket 370 is aligned with the opening of female latching plate 365 during the front closed-position, so that male latching rod 350 may extend therethrough securing casket front 20 to casket right side 58 (and casket left side 54).

Extension rod 345 follows the length of casket front 20 from stirrup 330 to male latching rod 350. Extension rod 345 is fastened to male latching rod 350 via a hole through the diameter of male latching rod 350, which extends through and lies within the central openings of support plate 355 and female latching plate 365. Male latching rod 350 has an increased radius part 362 close to female plate 365. Spring 360 is wrapped about a portion of male latching rod 350 between the vertical portion of support plate 355 and increased radius part 362. The force of spring 360 exerted outward against support plate 355 and increased radius part 362 maintains latching mechanism 300 in the equilibrium position of being latched, where male latching rod 350 extends through female latching plate 365 and bracket 370.

Sample methods for single-handedly transferring box 80 from casket 10 onto a dolly will now be discussed with attention to the functionalities of the above-described structures. With principal reference to FIG. 1, casket 10 is shown in a top-closed position. A user can single-handedly move casket top 30 into an open position, such as that shown in FIGS. 3 through 5, by actuating manually-actuable locking mechanisms 200. As shown in FIGS. 24 through 26*b*, a user turns handle 210 in a counter-clockwise direction, and the counter-clockwise rotational motion of handle 210 is translated into rotational motion of male locking piece 230 out of engagement with female locking piece 220 and casket front slot 240. In preferred embodiments including two manually-actuable locking mechanisms 200, the user turns each handle 210 counterclockwise to release each female locking piece 220. Top 30 is single-handedly lifted into the open position after handles 210 are turned to release female locking pieces 220 from male locking pieces 230.

Figure 5:
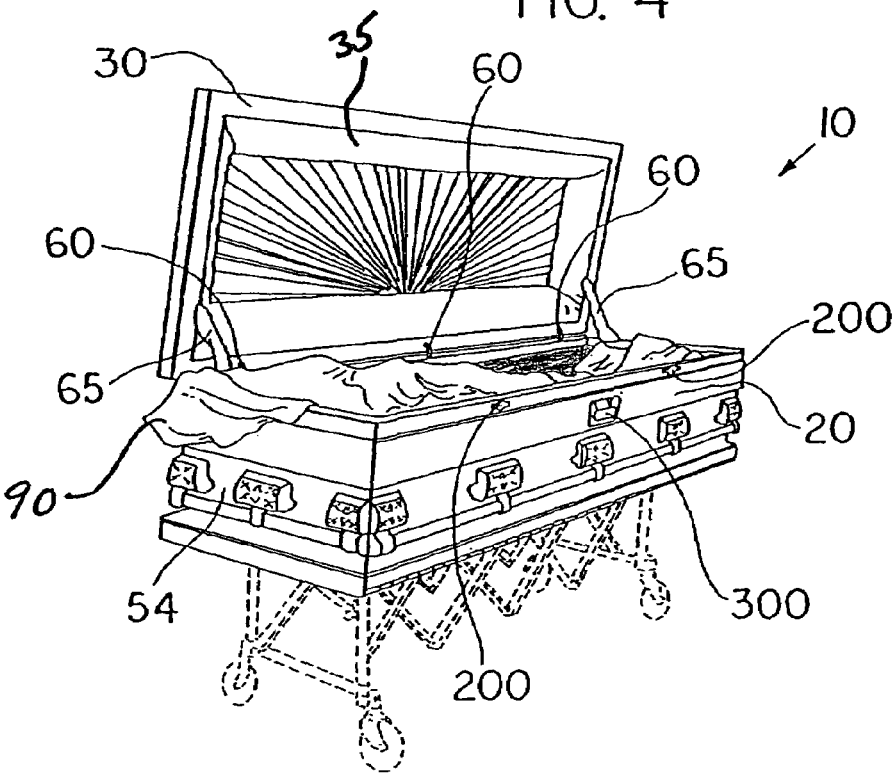
FIG. 5 is a corner perspective view of the reusable casket shown in FIGS. 1 through 4, with the reusable casket again being shown resting on a table cart which is not part of this invention.

Referring to FIGS. 4 and 5, fabric 90 is then removed from its position covering the top edges of box 80, casket 10 and any gaps between. Fabric 90 is preferably discardable and is optionally placed inside of box 80 with any human remains for transportation to a crematorium or cemetery.

As shown in FIG. 6, a user then single-handedly unlatches the top of casket front 20 from left casket end 54 and right casket end 58 via latching mechanism 300. With principal reference to FIGS. 27 through 33, the user initiates unlatching by pulling up latch handle 305. Lifting latch handle 305 causes handle arms 310 to rotate about arm pivot 315 and resistance pivot 320. As handle arms 310 rotate about free pivot 315 and resistance pivot 320, the ends of arms 310 opposite latch handle 305 press downward on the tops of stirrups 330, thereby forcing stirrups 330 to rotate about shared central stirrup pivot 335.

Continuing with principal reference to FIGS. 27 through 33, when the user single-handedly pulls latch handle 305, the bottoms of stirrups 330 rotate inwardly towards each other, thereby pulling extension rods 345 inwardly and away from left casket end 54 and right casket end 58. This exerts a compressing force on spring 360. As extension rods 345 move inward, male latching rod 350 is pulled in an inward direction, out of the central opening of bracket 370, thereby releasing casket front 20 from being secured to left casket end 54 and right casket end 58.

Referring to FIGS. 6 through 9, the user then positions casket front 20 into an open-position by rotating casket front 20 downward one hundred eighty degrees (180°) about hinge 70. This may be done single-handedly, while the user is actuating handle 305. The user then pulls on box 80, which pulls tray 110 across track assemblies 130 into an extended position from casket 10. The extended position facilitates removal of box 80 onto a dolly.

Referring to FIGS. 10 through 23, tray 110 and track assemblies 130 will now be discussed in further detail. As principally shown in FIG. 16, tray 110 lies on top of each track assembly 130 and is attached to a plurality of slotted webs 120, which are in turn secured to track assemblies 130 via rods 160 and cotter pins 165. The combinations of slotted webs 120 and rods 160 allow for movement of the tray along rollers 150.

Figure 12:
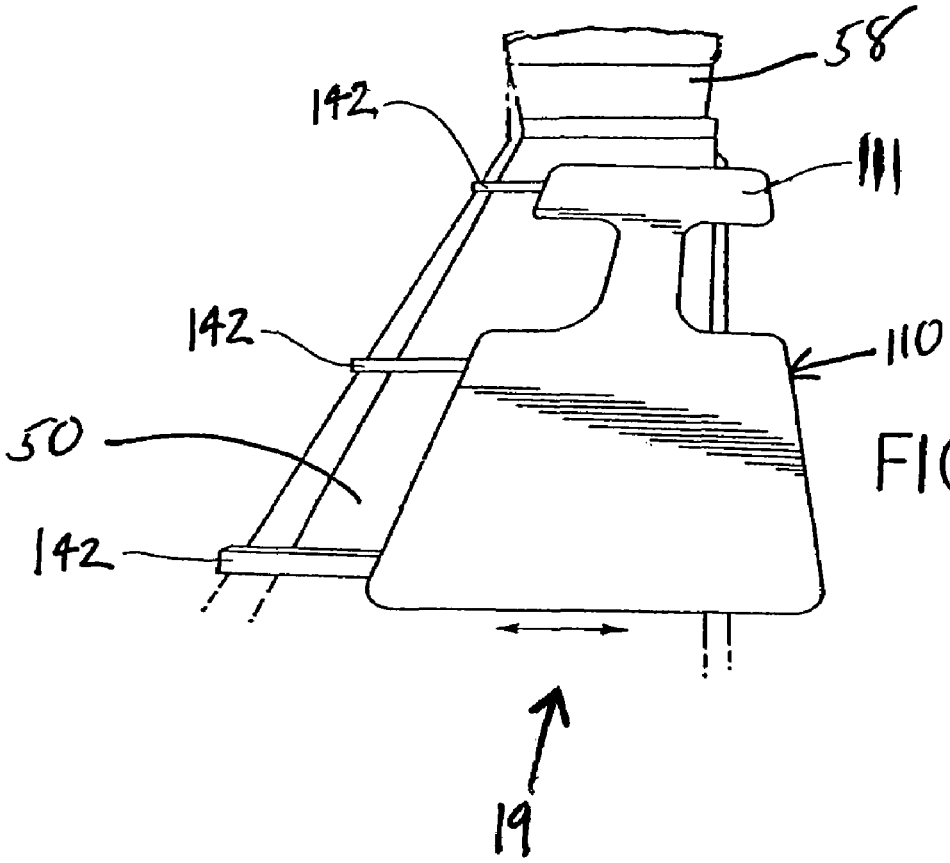
FIG. 12 is a perspective view illustrating linear lateral motion of the tray shown in FIG. 11 over the bottom interior of the casket shown in FIG. 10 and showing the interior surface of the casket right side.
Figure 13:
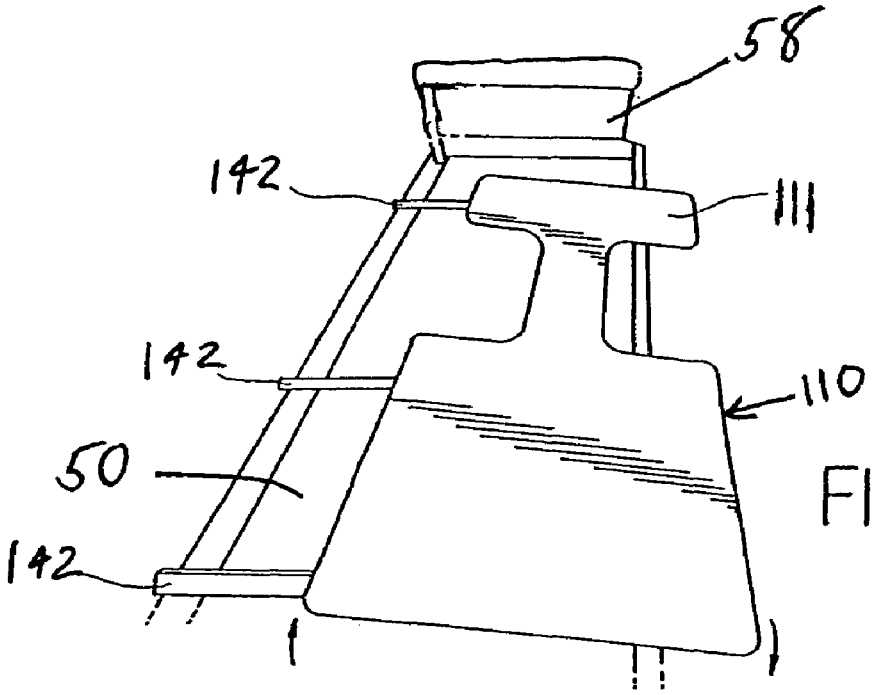
FIG. 13 is a perspective view showing skew or rotary motion relative to a vertical axis of the tray shown in FIG. 11 over the bottom interior of the casket shown in FIG. 10 and showing the interior surface of the casket right side.
Figure 14:
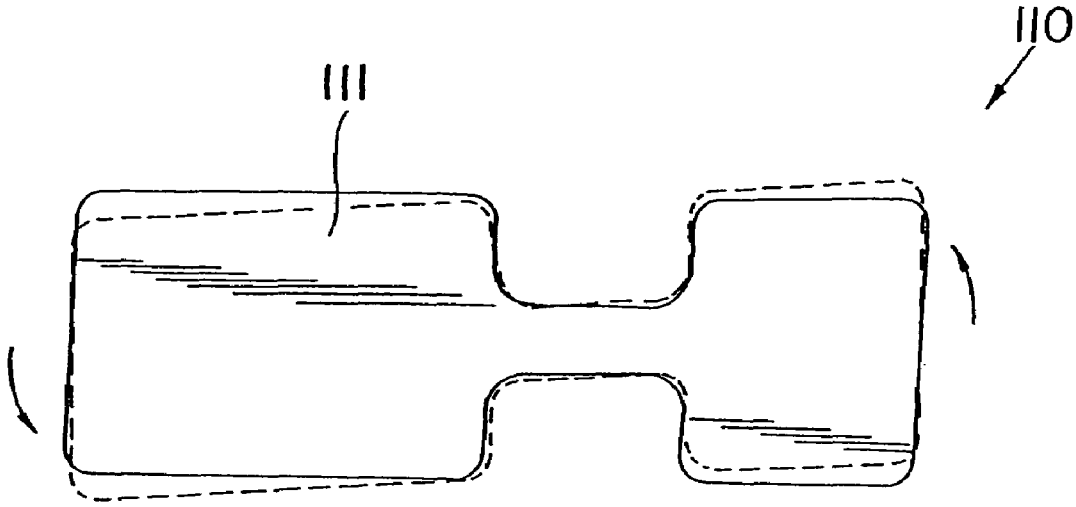
FIG. 14 is a top view showing counterclockwise rotary motion in a horizontal plane of the tray shown in FIG. 11.
Figure 15:
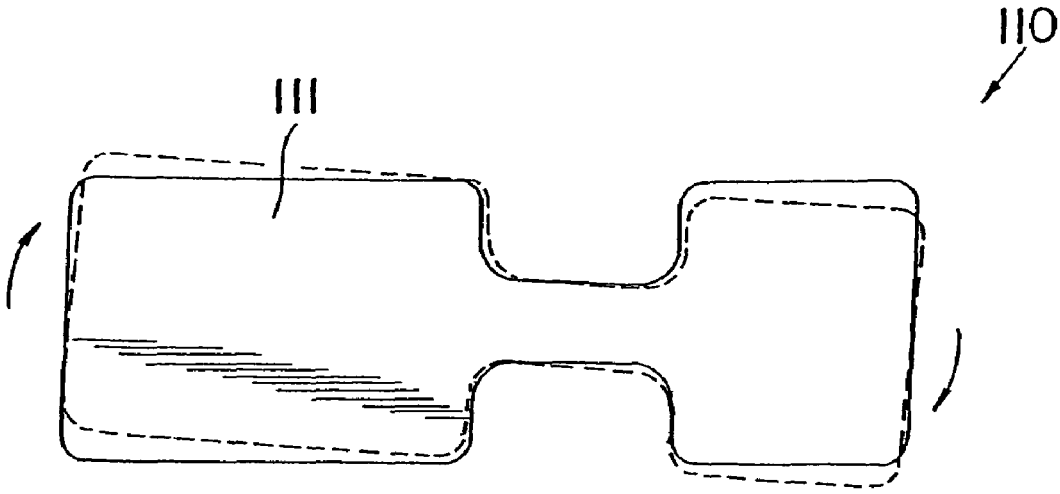
FIG. 15 is a top view showing clockwise rotary motion in a horizontal plane of the tray shown in FIG. 11.
Figure 22:
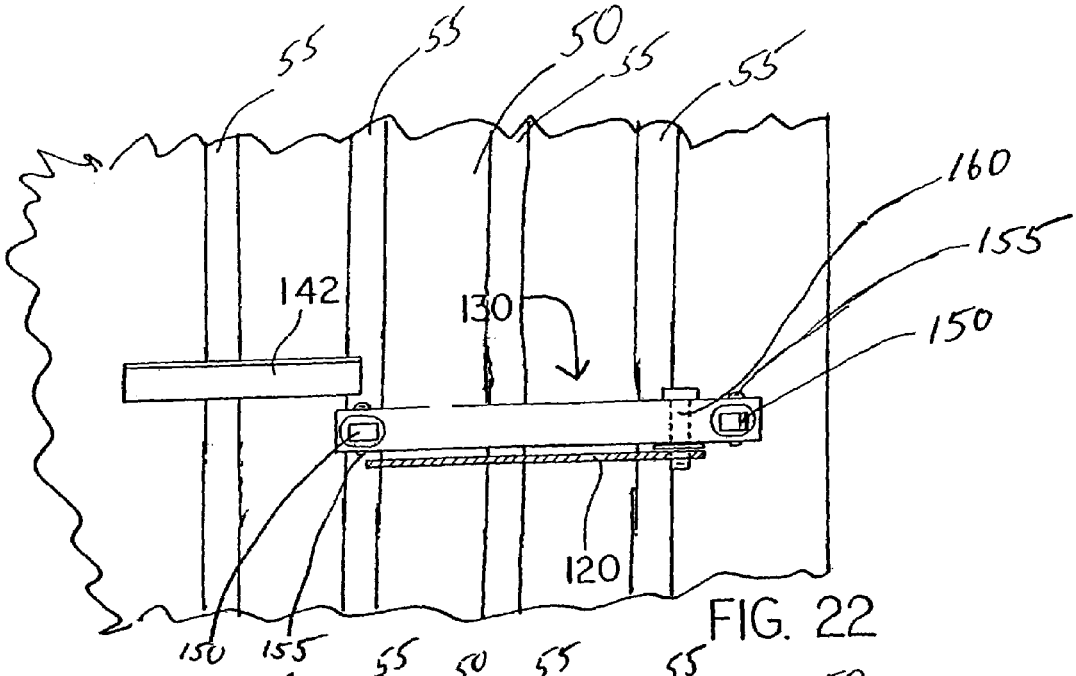
FIG. 22 is a partial top view showing a slotted web of the tray-track assembly illustrated in FIGS. 19 through 21 in a retracted position, with a vertically extending steel plate portion of the tray shown in section.
Figure 23:
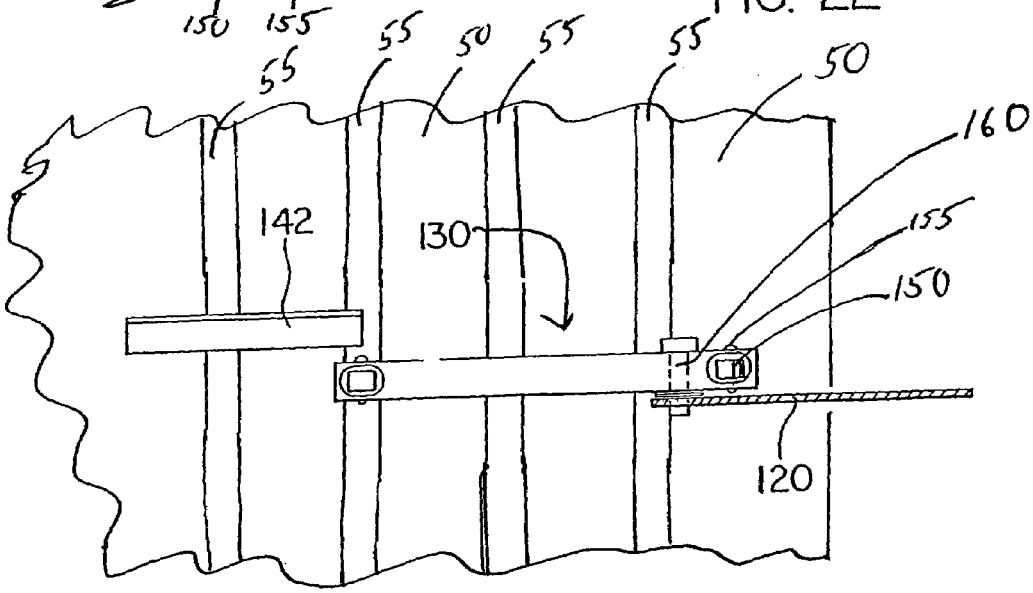
FIG. 23 is a partial top view similar to FIG. 22 but showing the slotted web in an extended position.

Being secured to track assemblies 130, steel plate 111 is capable of at least three types of movement, including linear latitudinal motion across casket 10, horizontal rotational motion and vertical rotational motion. The mobility of tray 110 facilitates the single-handed transfer of box 80 from casket 10 onto a dolly. For example, a user can single-handedly slide steel plate 111 laterally out of casket 10 onto a dolly, horizontally rotate steel plate 111 to line up casket 110 with the dolly, and/or vertically rotate steel plate 111 so that the height of plate 111 is at a height equal to the dolly. Once steel plate 111 is properly lined up with the dolly, one hand can be used to pull box 80 off tray 110 onto the dolly. The three different types of motion will now be discussed in further detail:

With respect to latitudinal linear motion, FIGS. 12, 22 and 23 show that tray 110 can be pulled out-of casket 10 into an extended position and pushed into casket 10 into a retracted position. Rollers 150 smooth the motion of tray 110 as tray 110 is extended and retracted. Generally speaking, the distance that tray 110 can be extended and/or retracted is proportional to the length of slots 125.

With respect to horizontal rotational motion, FIGS. 13 through 18 show that tray 110 can rotate horizontally along rollers 150. Rotation does not necessarily occur about a central axis of rotation. A length of rod 160 is shown in FIG. 18 between elongated hollow rectangular cross sectioned runner 140 and Cotter pin 165, permitting motion of tray 110 to have a horizontal vector component parallel with casket rear 40 and casket front 20. Cotter pin 165 restrains slotted web 120 and tray 110 from undesired lateral motion as shown in FIG. 17, for example. Greater amounts of horizontal rotational motion are possible as the length of rod 160 between runner 140 and cotter pin 165 is greater.

Figure 20:
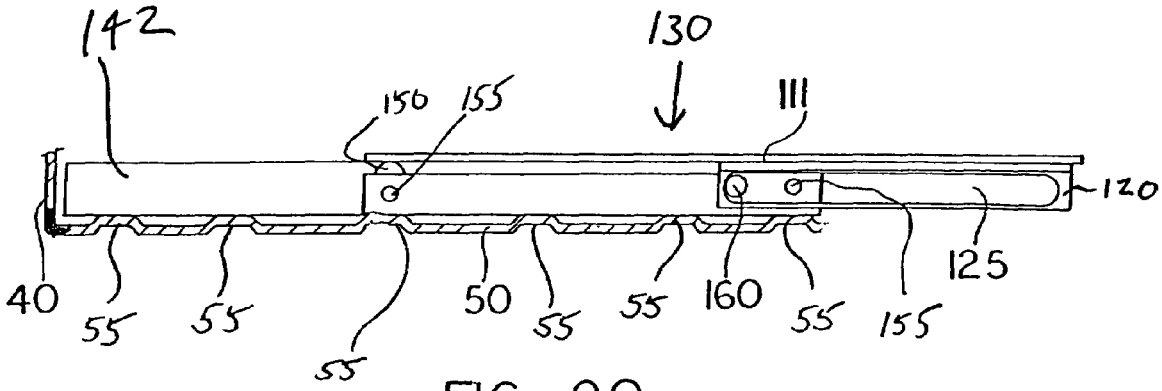
FIG. 20 is a side view of a track and tray assembly of FIG. 19, with the ridges of the casket bottom being shown and with the tray in a fully extended position.
Figure 21:
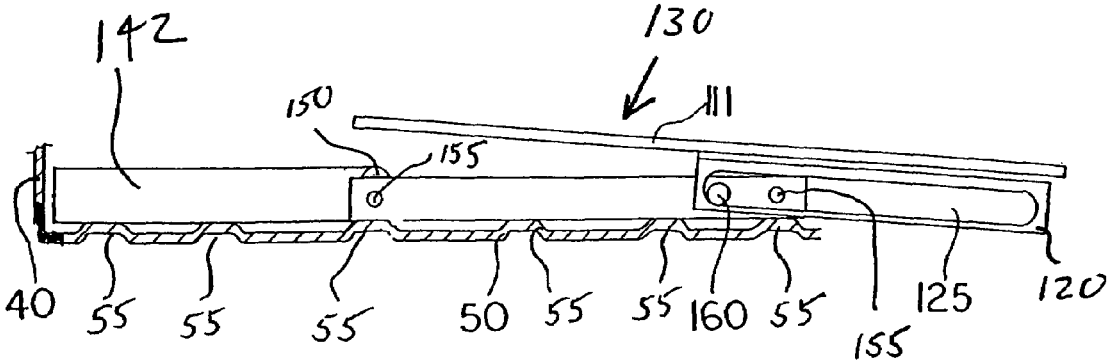
FIG. 21 is a side view of a track and tray assembly, with the ridges of the casket bottom being shown and with the tray in a fully extended and slightly vertically rotated position.

With respect to vertical rotational motion, FIGS. 20 and 21 show an example of tray 110 undergoing vertical rotational motion. As shown, the diameter of rod 160 is preferably less than the lateral width of slot 125 in slotted webs 120, allowing rod 160 to move vertically within slot 125. In this sense, rod 160 does not necessarily comprise the axis of rotation for the vertical rotational motion of tray 110.

Once tray 110 is lined up with a dolly, box 80 can be single-handedly pulled off tray 110 onto the dolly for discarding via cremation, placement in a cemetery etc.

After box 80 is removed from casket 10, the user pushes tray 110 back into its retracted position. For easy storage, the user can then close and latch casket front 20 via latching mechanism 300 and close and lock casket top 30 via locking mechanism 200. As shown in FIG. 32, for example, casket front 20 can be latched to left casket end 54 and right casket end 58 by lifting latch handle 305, lining up male latching rod 350 with female latching plate 365 and bracket 370, and then releasing latch handle 305. The restoring force of spring 360 pushes out against both the increased radius part 362 and the vertical portion of support plate 355, thereby pushing male latching rod 350 into the central space of bracket 370. The restoring force of spring 360 also pushes extension rods 345 outward towards left casket end 54 and right casket end 58, thereby rotating stirrups 330 about central pivot 335 and pushing arms 310 and handle 305 into the initial equilibrium position. The restoring force of resistance pivot 320 also forces handle arms 310 and latch handle 305 into the initial equilibrium position.

The user can then close and lock casket top 30. With the lock handles 210 being turned counterclockwise, the user single-handedly lowers casket top 30 so that it rests upon the top edges of left casket end 54, right casket end 58, casket front 20, and casket rear 40. The user than rotates handle 210 clockwise. The rotational motion of handles 210 are translated into rotational motion of male locking piece 230, which is moved through casket front slot 240 and inside female locking piece 220, thereby securing casket top 30 to casket front 20. Reusable casket 10 can then be stored for future use with a new box 80 and fabric 90.

Although there has been hereinabove described a reusable casket and a method for single-handedly transferring human remains, for the purposes of illustrating the manner in which the invention may be used to advantage, it should be appreciated that the invention is not limited thereto. Accordingly, any and all modifications, variations, or equivalent arrangements, whether or not currently foreseeable, which may occur to one skilled in the art should be considered to be within the scope of the invention as defined in the appended claims.

What is claimed is:

1. A reusable casket comprising:

a. a body including:

i. a top hingedly connected to a rear of said body for pivotal movement between a casket-open position and a casket-closed position at which said top is in edge-wise alignment with two ends and a front of said body and said rear;

ii. said front being spaced from said rear and pivotally connected to a bottom of said body for movement through an arc at least approaching one hundred eighty degrees between a casket-closed position at which said front is in edge-wise alignment with said ends, and with said top if said top is in the casket-closed position, and a casket-open position at which said front is in edge-wise alignment with only said bottom;

iii. latching means at common edges of said front and said two ends for latchingly retaining said front in said casket-closed position;

iv. manually actuable means for releasing, in a single hand action, said latching means retaining said front in said casket-closed position;

b. a tray for supporting a disposable crematable container for human remains, positioned parallel and proximate to the casket bottom and being slideably movable from within said casket to a position at which said tray extends at least partially out of said casket when said front is in said casket-open position; and c. means on said bottom, for supporting said tray during tray movement along said bottom.

2. The reusable casket of claim 1 wherein the manually actuable means are mounted in said top and further comprise means for lockingly securing said top to said front when said top and front are in their respective casket-closed positions in edge-wise alignment.

3. The reusable casket of claim 1 further comprising means for retaining said tray in proximity to said bottom and defining first and second positions of the tray.

4. The reusable casket of claim 3 wherein said tray retaining means permits a preselected amount of tray lateral movement as said tray moves between said first and second positions and permits a preselected amount of tray skew movement as said tray moves between said first and second position; and wherein said tray retaining means further includes:

a. a plurality of slotted webs fixedly connected to said bottom with said slots extending in the direction of tray movement between said first and second positions;

b. at least one rod connected to said tray and residing within at least one of said web slots, interference of said rod with ends of a web slot in which said rod resides defining said first and second positions of said tray; and c. means for retaining said rod within said slot.

5. A reusable casket of generally rectangular solid configuration when closed, comprising:

a. a top connected to a rear of said casket for pivotal movement between a casket-open position and a casket-closed position at which said top is in facing contact with two ends, a front and the rear of said casket;

b. said front being connected to a bottom of said casket for movement through an arc between a casket-closed position at which said front is in edge-wise contact with said ends, and with said top if said top is in the casket-closed position, and the casket-open position at which said front is separated from said ends;

c. means at juncture of said front and said two ends for latchingly retaining said front in said casket-closed position;

d. an exterior handle for releasing said latching means retaining said front in said casket closed position in a single action;

e. a tray for supporting for human remains, parallel with and proximate to the casket bottom and being slideably movable therealong between a first position within said casket and a second position at which said tray extends at least partially out of said casket and over said front when said front is in said casket-open position; and f. means for rotatably supporting said tray during tray movement along said bottom.

6. The reusable casket of claim 5 wherein said front forms a surface of said rectangular solid configuration, positioned generally parallel with and spaced from said rear when said casket is closed;

wherein said means for latchingly retaining said front in said casket-closed position is operable responsively to single-handed manual force applied to said handle;

further comprising single-handed manually actuable locking means connected to said top for securing said top to said front when said top and front are in their respective casket-closed positions;

further comprising a fabric head panel mounted in the interior of said top;

wherein said tray is further for supporting a disposable crematable container housing human remains;

wherein said means for rotatably supporting said tray during tray movement along said bottom include rollers;

wherein said means for rotatably supporting said tray during tray movement along said bottom include bearing assembles;

further comprising means for retaining said tray in proximity to said bottom and defining said first and second positions of said tray while permitting tray lateral and skew movement as said tray moves between said first and second positions;

wherein said tray retaining means further comprises:

a. a plurality of slotted webs fixedly connected to said bottom with said slots running generally in the direction of tray movement between said first and second positions;

b. at least one rod connected to said tray and residing within said web slots, interference of said rod with ends of said web slots in which said rod resides defining first and second positions of said tray; and c. means for retaining said rod within said web slot in which said rod resides;

wherein said tray is single-handed manually movable;

wherein said front is pivotally connected to a bottom of said casket for pivotal movement through an arc of at least about 180 degrees between said casket-closed position at which said front is in edge-wise contact with said ends and a casket-open position at which said front is essentially parallel with said rear portion;

further comprising a piano hinge connecting said front and said bottom, running substantially the length of said front and bottom;

wherein said exterior handle of the manually actuated locking means is recessed within said movable front;

wherein adjoining edges of said movable front and said ends are flush with one another when said casket is fully closed and said locking means are within said front, hidden from view when said casket is closed;

wherein said locking means are spring loaded, push-to-close latches;

wherein said handle includes a mechanism for converting handle rotation about a horizontal axis into longitudinal movement along substantially that horizontal axis to effectuate release of said locking means retaining said front said casket-closed position in a single manual action; and further comprising means for converting manually applied force and resultant displacement transversely to said casket front into unlatching rod axial movement parallel with and along said front.

7. A method for transferring optionally boxed human remains from a casket interior on to an adjacent support for transport of said remains, comprising the steps of:

a. releasing a top of the casket from any casket sides to which the top may be fastened;

b. opening the casket top to a position for retention thereat by rotating the casket top about a connection with one side of the casket;

c. releasing a casket front from any adjoining sides of said casket to which the front may be fastened;

d. moving said released casket front, away from said any adjoining sides, about a connection with a casket bottom to a position at which said casket front is in a vertical plane and below the casket bottom;

e. moving a tray supporting said optionally boxed human remains along said casket bottom from a position fully within said casket to a position at which said tray at least partially overlies said casket front; and f. moving said optionally boxed human remains off said tray and onto said adjacent support for transport.

8. The method of claim 7 wherein moving the released casket front further comprises moving the released casket front to a position at which the released casket front is parallel with the casket front position prior to release.

9. The method of claim 7 wherein moving the released casket front further comprises rotating the released casket front through an angle of one hundred eighty degrees.

10. A reusable casket comprising:

a. a six sided body including:

i. a top forming a surface of said body and being hingedly connected to a rear surface of said body for pivotal movement between a casket-open position and a casket-closed position at which said top is in facing contact with two ends, a front and rear surface;

ii. the front forming a surface of said body positioned generally parallel with and spaced from said rear surface, connected to a bottom of said body for movement through an arc between the casket-closed position at which said front is in edge-wise contact with said ends, and with said top if said top is in the casket-closed position, and the casket-open position;

iii. means at juncture of said front and said two ends for retaining said front in said casket-closed position;

iv. single-handed manually operable means on the center exterior of said front, for releasing said front retaining means in a single action; and b. means for supporting a disposable cremateable container housing human remains, mounted on the casket bottom and being movable therealong between a first position within said casket and a second position at which said support means extends at least partially out of said casket.

11. The reusable casket of claim 10 wherein said supporting means further comprises bearing means connected to said bottom within said body for facilitating movement of said supporting means along said bottom; and further comprising manually actuated locking means mounted in said top for securing said top to said front when said top and front are in their respective casket-closed positions;

a fabric head panel mounted in the interior of said top; and means for removably retaining said fabric head panel within said interior of said top and being actuable to release said fabric head panel upon application of pulling force with one hand in a direction generally perpendicular to said panel;

wherein said supporting means is positioned parallel and proximate to said casket bottom;

wherein said supporting means extends at least partially out of said casket in an orientation parallel with said bottom at said second position;

wherein said bearing means further comprise a plurality of rollers;

wherein said roller axes are transverse to the direction of movement of said supporting means along said bottom.

12. The reusable casket of claim 10 further comprising means for retaining said supporting means in proximity to said bottom, defining said first and second positions of said supporting means and permitting a preselected amount of lateral and skew movement thereof manifesting slop as said supporting means moves between said first and second positions;

wherein said retaining means further comprises:

a. slotted webs connected to said bottom of said supporting means with said slots being in the direction of supporting means movement between said first and second positions;

b. at least one rod connected to said supporting means and residing within said web slots, where interference of said rod with ends of said web slot in which said rod resides defines said first and second positions of said supporting means; and c. means for retaining said rod within said slot in which said rod resides.

13. The reusable casket of claim 10 wherein said supporting means at said second position is generally perpendicular to said front when said front is fully in said casket-open position;

wherein said supporting means is positioned parallel to the casket bottom.

14. The reusable casket of claim 13 further comprising means for removably retaining a fabric head panel within an interior portion of said top responsively to compressive force manually applied in a direction to push said fabric head panel against said interior portion of said top.

15. A reusable casket comprising:

a. a body including:

i. a top hingedly connected to a rear of said body for pivotal movement between a casket-open position and a casket-closed position at which said top is in facing contact with two ends and said rear of said body;

ii. a front positioned generally parallel with and spaced from said rear, pivotally connected to a bottom of said body for pivotal movement between a casket-closed position and a casket-open position at which said front is vertically displaced from said casket closed position;

b. a tray for supporting a disposable crematable container for human remains, being slideably movable along said bottom from within said casket to a position at which said tray extends at least partially out of said casket when said front is in said casket-open position;

c. a means for rotatably supporting said tray during tray movement along said bottom;

d. a mechanism for converting handle rotation of a horizontal axis into longitudinal movement along substantially that horizontal axis to effectuate release of locking means retaining said front in said casket-closed position in a single manual action.

16. The reusable casket of claim 15 wherein said mechanism further comprises means for converting manually applied force and resultant displacement of said handle transversely to said casket front into latching rod axial movement parallel with and along said casket front.

17. The casket of claim 15 further comprising means for retaining said tray in connection with said casket, defining extremity positions of said tray and permitting a preselected amount of tray lateral and skew movement manifested as slop, as said tray moves along said bottom, comprising:

i. at least one slotted web connected to said bottom with said slot extending in the direction of tray movement; and ii. at least one rod connected to said tray and residing within said slot, interference of said rod with slot ends defining extremity positions of said tray.

18. A method for single-handedly transferring boxed human remains from a casket interior onto an adjacent dolly for transport of said remains, comprising the steps of:

a. single-handedly releasing a top of the casket from casket sides;

b. opening the casket by raising the casket top by manually rotating the casket top about a hinge connection to the remainder of the casket;

c. single-handedly rotatably moving a handle connected to a casket front thereby converting handle rotation about a horizontal axis into longitudinal movement along substantially that horizontal axis and converting manually applied force and resultant handle displacement transversely to said casket front into unlatching rod axial movement parallel with and along said front to effectuate release of locking means retaining said front in a casket-closed position in a single manual action, thereby releasing said casket front from edgewise contact with edges of respective upstanding ends of said casket;

d. single-handedly pivoting said now-released casket front away from said edges of said upstanding ends about a pivotal connection through an angle of at least 90 degrees, e. single-handedly sliding a movable tray supporting said boxed human remains laterally along said casket bottom from a position fully within said casket to a position at which said tray overlies said casket front; and f. single-handedly moving said boxed human remains slidably off of said tray and onto said adjacent transport dolly.

19. A casket comprising:

a. a panel movable through an angle of greater than ninety degrees between a first position at which said panel is vertically disposed and said casket is closed by said panel and a second position providing an opening to said casket;

b. a tray for human remains connected to the casket interior, being movable from within said casket to a position at which said tray extends at least partially out of said casket at an opening created by said panel being at said second position c. latching means at said panel for latchingly retaining said panel in said first position; and d. manually actuable means for releasing, in a single hand action, said latching means retaining said panel in said first position;

20. The reusable casket of claim 19 wherein the panel is movable through an angle of one hundred eighty degrees.

21. The casket of claim 19 wherein the panel is pivotally movable and when at the second position is below an interior bottom surface of the casket.

22. The casket of claim 19 wherein the panel is pivotally movable between said first and second positions and extends vertically at each.

* * * * *